US007559632B2

(12) United States Patent
Kodama

(10) Patent No.: US 7,559,632 B2
(45) Date of Patent: Jul. 14, 2009

(54) INKJET RECORDING HEAD AND IMAGE FORMING APPARATUS COMPRISING INKJET RECORDING HEAD

(75) Inventor: Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 442 days.

(21) Appl. No.: 11/585,857

(22) Filed: Oct. 25, 2006

(65) Prior Publication Data

US 2007/0091150 A1 Apr. 26, 2007

(30) Foreign Application Priority Data

Oct. 26, 2005 (JP) ..... 2005-311633

(51) Int. Cl.
*B41J 2/045* (2006.01)
*B41J 2/175* (2006.01)

(52) U.S. Cl. ..... 347/68; 347/85

(58) Field of Classification Search ..... 347/45, 347/47, 68, 85
See application file for complete search history.

(56) References Cited

U.S. PATENT DOCUMENTS 6,247,789 B1 * 6/2001 Sanada ..... 347/45
6,637,868 B2 * 10/2003 Yamamoto et al. ..... 347/68

FOREIGN PATENT DOCUMENTS

JP 2003-191470 A 7/2003

* cited by examiner

*Primary Examiner*—An H Do
(74) *Attorney, Agent, or Firm*—Birch, Stewart, Kolasch & Birch, LLP

(57) ABSTRACT

The inkjet recording head includes: a pressure chamber to which ink is supplied from an ink supply side; a nozzle plate including a nozzle which is connected to the pressure chamber and ejects the ink; and a circulation flow channel plate which is disposed on an opposite side of the nozzle plate from an ink ejection side, and includes: a circulation flow channel for expelling the ink from a vicinity of the nozzle; and a first nozzle flow channel for connecting the nozzle with the pressure chamber, wherein: at least a portion of the circulation flow channel plate is made of a porous member; a contact angle of the ink at an inner surface of the nozzle of the nozzle plate and a contact angle of the ink at an ink ejection side surface of the nozzle plate are greater than a contact angle of the ink at an inner surface of the first nozzle flow channel; and relationship among an internal ink pressure P1 in the ink supply side, an internal ink pressure P2 in the circulation flow channel, and an atmospheric pressure P3, is expressed as follows: P3>P1>P2.

8 Claims, 17 Drawing Sheets

INKJET RECORDING HEAD AND IMAGE FORMING APPARATUS COMPRISING INKJET RECORDING HEAD

BACKGROUND OF THE INVENTION

1. Field of the Invention

The present invention relates to an inkjet recording head and an image forming apparatus comprising an inkjet recording head, and in particular, to maintenance technology for an inkjet recording apparatus which prevents the viscosity of liquid at a meniscus surface from increasing and enables stable ejection.

2. Description of the Related Art

As an image forming apparatus in the related art, an inkjet printer (inkjet recording apparatus) is known, which comprises an ink ejection head (inkjet recording head) having an arrangement of a plurality of nozzles and forms images on a recording medium by ejecting ink liquid droplets from the nozzles in the ink ejection head toward the recording medium while relatively moving the ink ejection head and the recording medium to each other.

Various methods are known in the related art as ink ejection methods for an inkjet recording apparatus of this kind. For example, a piezoelectric method, a thermal inkjet method, and the like, are known. According to the piezoelectric method, the volume of a pressure chamber (ink chamber) is changed by deforming a vibration plate which forms a portion of the pressure chamber because of deformation of a piezoelectric element (piezoelectric actuator), thereby supplying ink into the pressure chamber from an ink supply channel when the volume is increased and ejecting the ink inside the pressure chamber from a nozzle when the volume of the pressure chamber is reduced. Moreover, according to the thermal inkjet method, ink is heated to generate a bubble, thereby ejecting the ink on the basis of the energy of the bubble expansion.

In such an image forming apparatus including an ink ejection head as an inkjet recording apparatus, ink is supplied to the ink ejection head from an ink tank which stores the ink, via the ink supply channel, and the ink can be ejected by any one of the various ejection methods described above. It is preferable that the ink used in such an image forming apparatus be rapidly dried (evaporated) and fixed immediately after the ink droplets deposit onto the recording medium.

On the other hand, the nozzles in the ejection head are filled with ink at all times so as to carry out printing immediately whenever a print instruction is issued. If the ink inside the nozzles dries, then the ink ejection from the nozzles becomes unstable and therefore, during non-printing, the ink ejection head is sealed tightly with a cap so as to prevent the ink in the nozzles from drying.

Moreover, in a case of an image forming apparatus of a shuttle scanning type in which an ink ejection head moves back and forth reciprocally over the paper, during printing, ejection failures are prevented by expelling ink having an increased viscosity by means of a method where the piezoelectric elements are driven to perform ink ejection or the nozzles are suctioned by means of a negative pressure when the ink ejection head is in a position outside the paper. On the other hand, in an image forming apparatus of a line type ink ejection head which corresponds to the paper width and is suitable for high-speed printing, it is difficult to perform ejection and suctioning of this kind during printing.

In the image forming apparatus using a line type ink ejection head corresponding to the width of the paper, the ink in the nozzles is exposed to the air especially during printing, and the ink in the nozzles which have not performed ejection for a long period of time dries. Therefore, the viscosity of the ink rises and the ink at the meniscus surface increases. Consequently, there is a possibility that the nozzles are subjected to ejection failures due to the nozzle blockages or disappearance of the ink in the nozzles.

In order to prevent the viscosity of ink at a meniscus surface from increasing, Japanese Patent Application Publication No. 2003-191470 discloses an inkjet recording head that includes an orifice plate (nozzle plate) which has nozzles and is made of a porous member which can be impregnated with ink. In this inkjet recording head, a moisturizing liquid or ink is supplied to the porous member, thereby moistening the periphery of the meniscus and preventing the viscosity of ink at the meniscus surface from increasing.

However, this technology in the related art involves following problems.

In the technology disclosed in Japanese Patent Application Publication No. 2003-191470, the inkjet recording head has a composition in which an ink-repelling film is formed on the ejection side surface of the orifice plate (nozzle plate) made of the porous member in order to prevent the ink from leaking through the orifice plate to areas other than the periphery of the nozzles. In this case, the position at which the meniscus surface makes contact with a nozzle (the inner wall of nozzle) corresponds to an interface between the orifice plate made of porous material and the ink-repelling film. Accordingly, the following problems with the ink ejection may be created.

Specifically, in an inkjet recording head that includes piezoelectric actuators and adopts a pull-push ejection method which is one of the general ejection control methods and in which the meniscus is first pulled inward in a direction opposite to the ejection direction and then the ink is pushed outward, the meniscus infiltrates into the porous orifice plate. Hence the meniscus surface shape becomes asymmetrical in accordance with the shape of the porous material, and hence the ink ejection direction may be deflected or ejection failures may occur because air bubbles enter the porous member.

Moreover, even if a push ejection method in which the ink is ejected by pushing without first pulling the meniscus is used in order to avoid such problems, residual vibration (resonance) of the meniscus after ejection, which also occurs in the pull-push ejection method described above, occurs. Since ejection has already finished, then the residual vibration does not affect the ejection direction. However, in this case, air bubbles may be incorporated into the porous member, and thereby ink may not be ejected in the subsequent ejection operation. In the related art, although drive waveforms have accordingly been designed so as to reduce residual vibration of this kind, it is difficult to eliminate the influence of residual vibration completely.

Furthermore, in the technology disclosed in Japanese Patent Application Publication No. 2003-191470, if there is an increase in the viscosity of the ink at the meniscus surface, then suctioning is carried out by applying a negative pressure to the orifice plate made of a porous member, prior to printing a new sheet or page, thereby removing the ink of increased viscosity. However, the above technology is not effective against the ejection defects occurring as a result of the viscosity increase during printing a single sheet or page. Moreover, according to the above technology, the print speed declines because suctioning is carried out (if necessary) prior to printing a new sheet or page.

SUMMARY OF THE INVENTION

The present invention has been contrived in view of the foregoing circumstances, an object thereof being to provide an inkjet recording head and an image forming apparatus comprising an inkjet recording head, in order to prevent the viscosity of ink at a meniscus surface from increasing, prevent ink having increased viscosity from entering a pressure chamber and carry out stable ejection.

In order to attain the aforementioned object, the present invention is directed to an inkjet recording head, comprising: a pressure chamber to which ink is supplied from an ink supply side; a nozzle plate including a nozzle which is connected to the pressure chamber and ejects the ink; and a circulation flow channel plate which is disposed on an opposite side of the nozzle plate from an ink ejection side, and includes: a circulation flow channel for expelling the ink from a vicinity of the nozzle; and a first nozzle flow channel for connecting the nozzle with the pressure chamber, wherein: at least a portion of the circulation flow channel plate is made of a porous member; a contact angle of the ink at an inner surface of the nozzle of the nozzle plate and a contact angle of the ink at an ink ejection side surface of the nozzle plate are greater than a contact angle of the ink at an inner surface of the first nozzle flow channel; and relationship among an internal ink pressure P1 in the ink supply side, an internal ink pressure P2 in the circulation flow channel, and an atmospheric pressure P3, is expressed as follows: P3>P1>P2.

According to this aspect of the present invention, in the steady state where ink ejection has not been performed, the end (clip points) of the meniscus is situated at the boundary between the nozzle and the first nozzle flow channel. On the other hand, during ejection, the clip points of the meniscus do not make contact with the porous member of the circulation flow channel plate. Therefore, the meniscus surface does not become uneven and there is no infiltration of air bubbles. Moreover, in the steady state, due to the relationship between the internal ink pressures, the flow of the ink circulation travels from the pressure chamber to the meniscus and then into the porous member, and hence the viscosity of ink at the meniscus surface is prevented from increasing, and the ink having increased viscosity at the meniscus does not return from the nozzle to the pressure chamber. Consequently, the ink properties are always uniform and stable ejection can be achieved.

In order to attain the aforementioned object, the present invention is also directed to an inkjet recording head, comprising: a pressure chamber to which ink is supplied from an ink supply side; a nozzle plate including a nozzle which is connected to the pressure chamber and ejects the ink; a circulation flow channel plate which is disposed on an opposite side of the nozzle plate from an ink ejection side, and includes: a circulation flow channel for expelling the ink from a vicinity of the nozzle; and a first nozzle flow channel for connecting the nozzle with the pressure chamber; and a nozzle flow channel plate which is disposed on an opposite side of the circulation flow channel plate from the nozzle plate, and includes: a second nozzle flow channel for connecting the nozzle with the pressure chamber; and a refilling supply channel which supplies the ink to the second nozzle flow channel, wherein: at least a portion of the circulation flow channel plate is made of a porous member; a contact angle of the ink at an inner surface of the nozzle of the nozzle plate and a contact angle of the ink at an ink ejection side surface of the nozzle plate are greater than a contact angle of the ink at an inner surface of the first nozzle flow channel; relationship among an internal ink pressure P1 in the ink supply side, an internal ink pressure P2 in the circulation flow channel, and an atmospheric pressure P3, is expressed as follows: P3>P1>P2; and relationship among the internal ink pressure P2 in the circulation flow channel, the atmospheric pressure P3, and an internal ink pressure P4 in the refilling supply channel is expressed as follows: P3>P4>P2.

According to this aspect of the present invention, in the steady state, due to the relationship of the internal ink pressures, ink is supplied from the ink supply side to the nozzle and ink is expelled from the nozzle into the circulation flow channel. On the other hand, in a refilling state after ejection, ink is supplied to the nozzle from the ink supply side and the refilling supply channel. Consequently, ink having increased viscosity does not return from the circulation flow channel to the nozzle side, and stable ejection can be achieved.

Preferably, the inkjet recording-head further comprises a piezoelectric element which functions as a pressure generating device for ejecting the ink, wherein: the piezoelectric element is charged by applying a first charging waveform for driving the piezoelectric element to the piezoelectric element in such a manner that a meniscus of the ink moves in an ejection direction to an extent which does not cause the ink to be ejected; the piezoelectric element is charged by applying a second charging waveform for driving the piezoelectric element to the piezoelectric element in such a manner that the meniscus moves in the ejection direction to eject the ink; and relationship between a potential difference $\Delta V1$ of the first charging waveform and a potential difference $\Delta V2$ of the second charging waveform is expressed as follows: $\Delta V1<\Delta V2$.

According to this aspect of the present invention, by moving the meniscus surface in the nozzle ejection direction to an extent that does not produce ejection, it is possible to reliably prevent the clip points of the meniscus from reaching the region of the porous member. Therefore the meniscus surface does not become uneven and there is no infiltration of air bubbles, and stable ejection can thus be achieved.

Preferably, the relationship among the internal ink pressure P1, the internal ink pressure P2 and the atmospheric pressure P3 which is expressed as P3>P1>P2 is achieved by controlling a liquid level of at least one of an ink container connected to the ink supply side and an ink container connected to the circulation flow channel.

Preferably, at least one of the relationship among the internal ink pressure P1, internal ink pressure P2 and the atmospheric pressure P3 which is expressed as P3>P1>P2 and the relationship between the internal ink pressure P2, the internal ink pressure P4 and the atmospheric pressure P3 which is expressed as P3>P4>P2 is achieved by controlling a liquid level of at least one of an ink container connected to the ink supply side and an ink container connected to the circulation flow channel.

According to these aspects of the present invention, it is possible to simply adjust the internal ink pressures without using a large-scale device, and stable ejection can be achieved.

In order to attain the aforementioned object, the present invention is also directed to an image forming apparatus comprising one of the inkjet recording heads described above.

According to this aspect of the present invention, stable ejection can be achieved at all times, and therefore an image of stable quality can be obtained.

According to the present invention, as described above, the meniscus surface in the nozzle does not make contact with the porous member of the circulation flow channel plate, thus preventing the occurrence of unevenness in the meniscus surface or the infiltration of air bubbles. Furthermore, the ink is made to flow from the pressure chamber to the meniscus surface and then to the porous member. Consequently, the viscosity of the ink at the meniscus surface is prevented from increasing, and the ink having increased viscosity at the meniscus does not return from the nozzle into the pressure chamber. Thus, the ink properties are uniform at all times and stable ejection can be achieved.

BRIEF DESCRIPTION OF THE DRAWINGS

The nature of this invention, as well as other objects and benefits thereof, is explained in the following with reference to the accompanying drawings, in which like reference characters designate the same or similar parts throughout the figures and wherein.

DETAILED DESCRIPTION OF THE PREFERRED EMBODIMENTS

Figure 1:
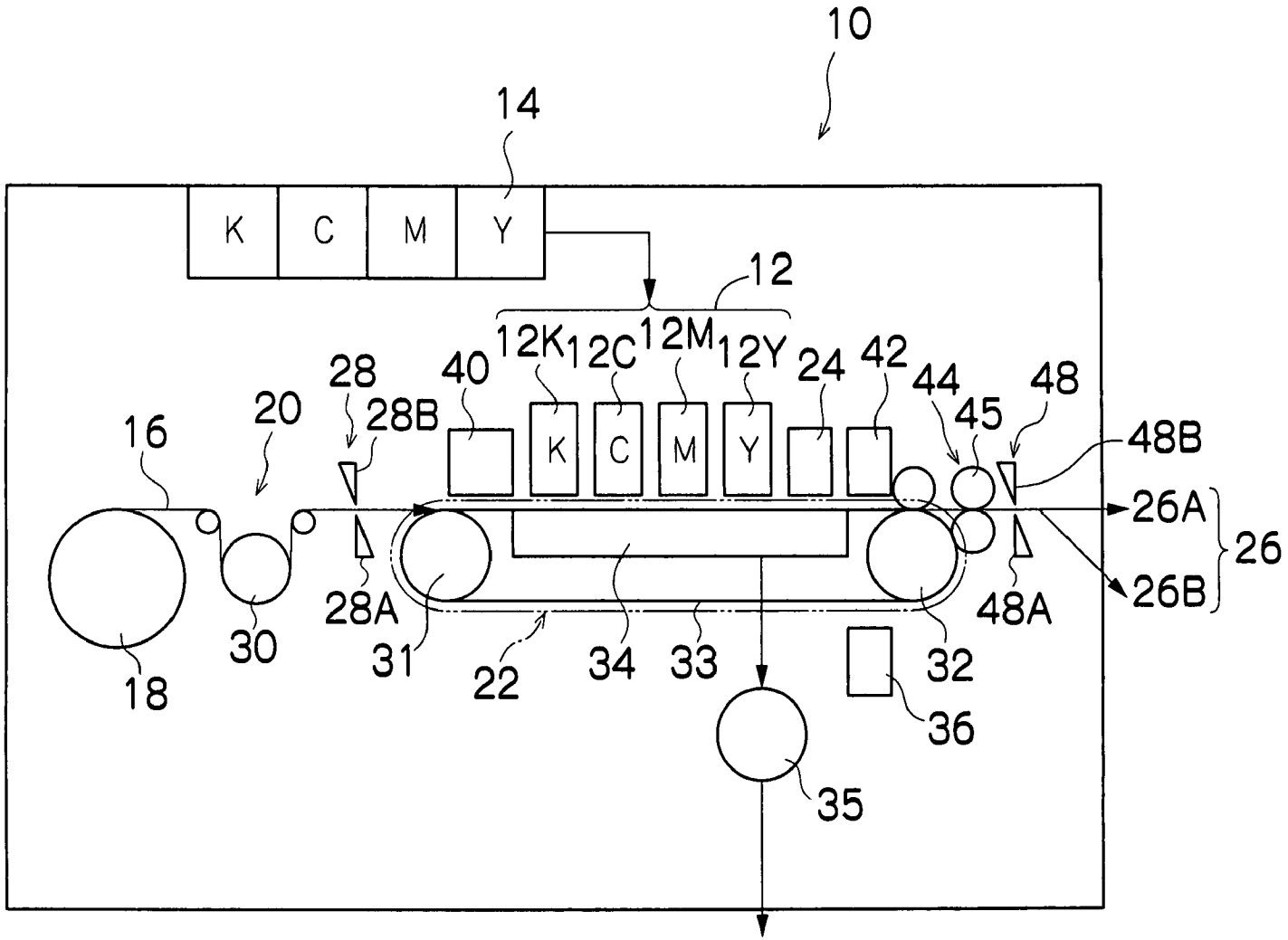
FIG. 1 is a general schematic drawing showing an approximate view of an inkjet recording apparatus forming an image forming apparatus including an inkjet recording head according to a first embodiment of the present invention.

FIG. 1 is a general schematic diagram showing an approximate view of an inkjet recording apparatus having an inkjet recording head according to a first embodiment in the present invention.

As shown in FIG. 1, the inkjet recording apparatus 10 comprises: a printing unit 12 having a plurality of print heads (inkjet recording heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying a recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size with the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 with a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (a flat surface).

The belt 33 has a width greater than the width of the recording paper 16, and a plurality of suction holes (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown in FIG. 1) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with a brush roller and a water absorbent roller, an air blow configuration in which clean air is blown onto the belt 33, or a combination of these. In the case of a configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Since the recording paper 16 is thus heated before printing, then the ink dries more readily after landing on the paper.

Figure 2:
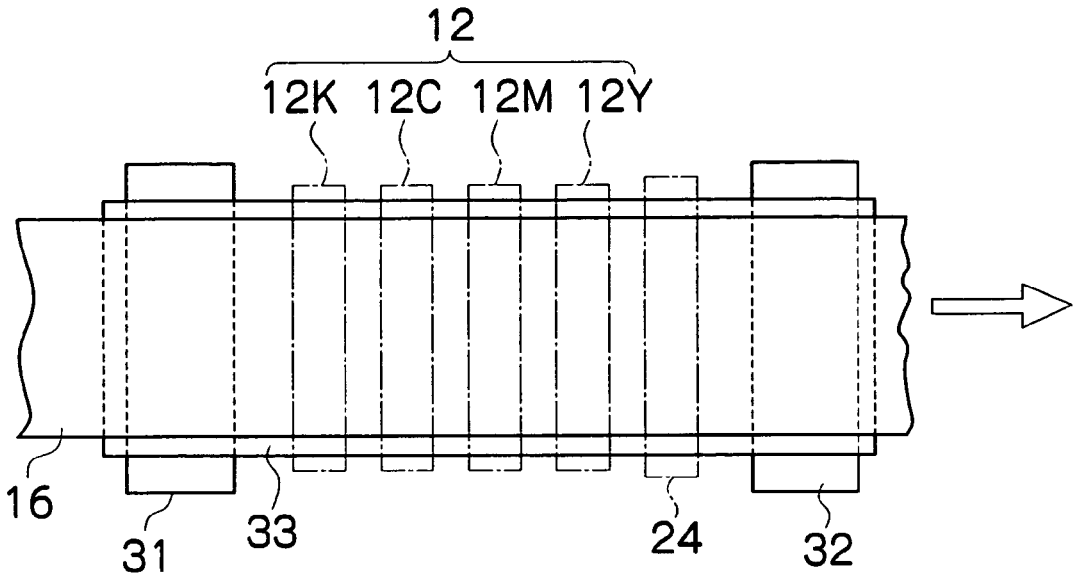
FIG. 2 is a plan view of a principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction, as shown in FIG. 2).

As shown in FIG. 2, each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (on the left hand side in FIG. 1), along the conveyance direction of the recording paper 16 (paper conveyance direction). A color image can be formed on the recording paper 16 by ejecting the inks from the print heads 12K, 12C, 12M, and 12Y, respectively, toward the recording paper 16 while conveying the recording paper 16.

The print unit 12, in which the full-line heads covering the entire width of the paper are thus provided for the respective ink colors, can record an image over the entire surface of the recording paper 16 by moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to the paper conveyance direction.

Here, the terms "main scanning direction" and "sub-scanning direction" are used in the following senses. In a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, and the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as blockages of the nozzles in the printing unit 12 from the ink-droplet deposition results determined by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Figure 3:
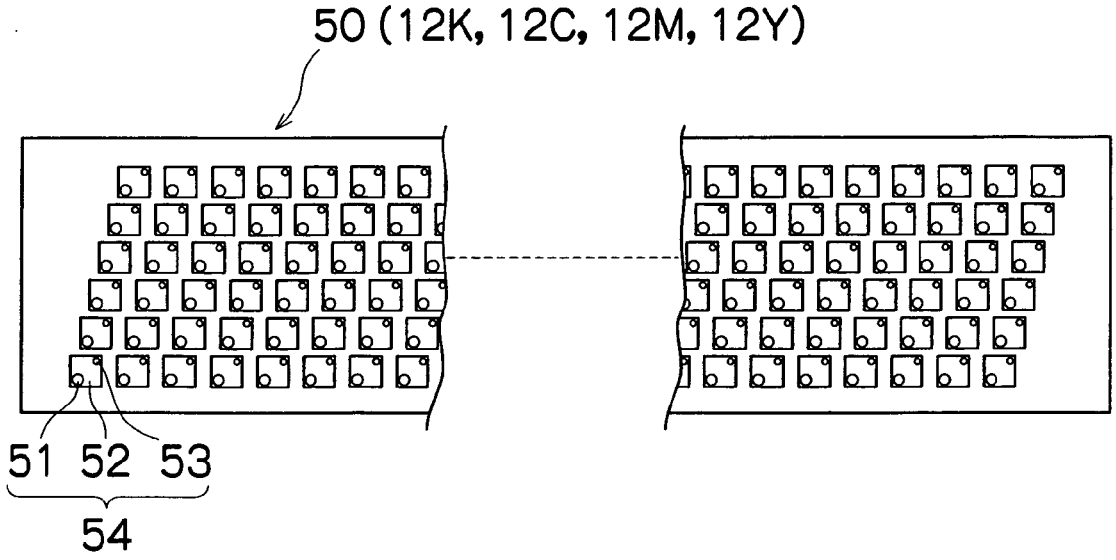
FIG. 3 is a plan perspective diagram showing an embodiment of the structure of a print head.

Next, the arrangement of nozzles (ejection ports) of a print head (ejection head) is described. The print heads 12K, 12C, 12M and 12Y provided for the respective ink colors each have the same structure, and a print head forming a representative embodiment of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by the nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind, but as one embodiment, 2400 nozzles per inch (npi) can be achieved by arranging the nozzles 51 in 48 lateral rows (21 mm) and 600 vertical columns (305 mm).

In the embodiment shown in FIG. 3, although the pressure chambers 52 each have an approximately square planar shape when viewed from above, the planar shape of the pressure chambers 52 is not limited to a square shape. As shown in FIG. 3, the nozzle 51 is formed at one end of the diagonal of each pressure chamber 52, and the ink supply port 53 is provided at the other end thereof.

Figure 4:
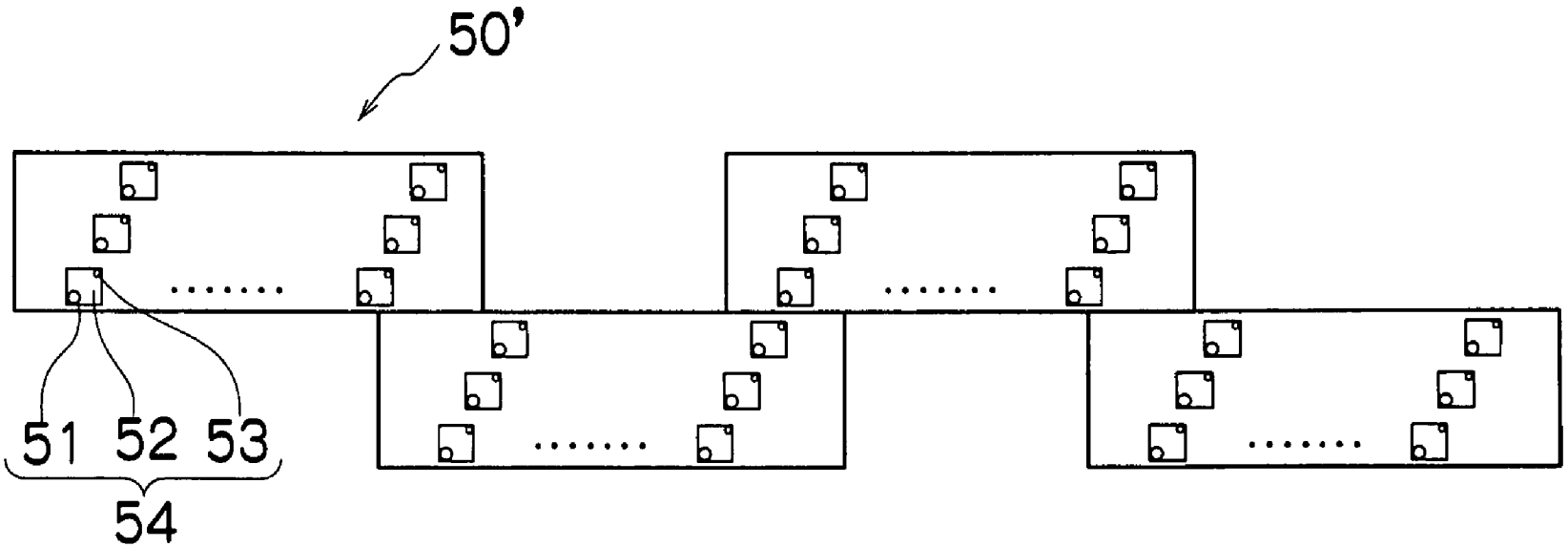
FIG. 4 is a plan view showing a further embodiment of the print head.

Moreover, FIG. 4 is a plan view perspective diagram showing a further embodiment of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

According to the present embodiment, as shown in FIG. 3, a high-density configuration of the nozzles 51 (for example, 2400 npi) is achieved by arranging the pressure chambers 52 (the nozzles 51) in a two-dimensional matrix configuration. Furthermore, according to the present embodiment, a common liquid chamber for supplying ink to the pressure chambers 52 is disposed directly above the diaphragm, thereby eliminating tubing that causes flow resistance in order to prioritize ink refilling characteristics. The ink is thus supplied directly from this common liquid chamber to the pressure chambers 52, and moreover the ink supply system is highly integrated. Furthermore, as described below, the electrical wiring for supplying drive signals to the electrodes (individual electrodes) of the pressure generating devices that deform the pressure chambers 52 rises upwards vertically from each individual electrode and is connected to upper wiring, such as a flexible cable, in such a manner that it penetrates the common liquid chamber.

Figure 5:
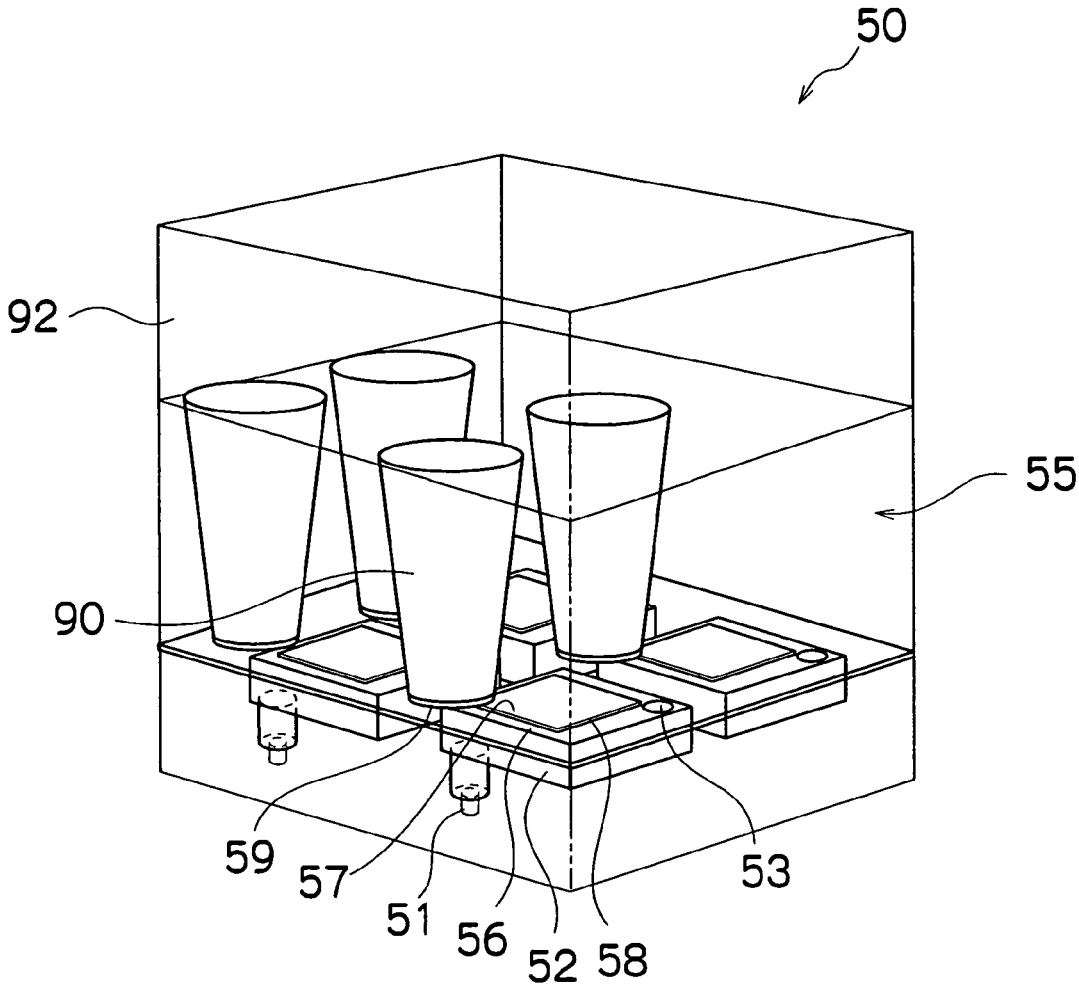
FIG. 5 is an oblique perspective diagram showing a partially enlarged view of a print head according to an embodiment of the present invention.

FIG. 5 is a diagram showing a simplified oblique perspective view of one portion of a print head 50, which is highly integrated in the way described above.

As shown in FIG. 5, according to the present embodiment, the print head 50 comprises: a diaphragm 56, which is disposed on pressure chambers 52 each having the nozzle 51 and the ink supply port 53, and forms the upper surfaces of the pressure chambers 52; piezoelectric elements 58 (piezoelectric actuators), which are disposed in positions on the diaphragms 56 corresponding to the respective pressure chambers 52, and form pressure generating devices each constituted by a piezoelectric body interposed between upper and lower electrodes; and individual electrodes 57, which are provided on the upper surface of the piezoelectric elements 58, respectively.

Electrode pads 59 forming electrode connecting sections are extracted (extended) to the outer sides from the end faces of the individual electrodes 57, and electrical wires 90 are formed on the electrode pads 59 so as to rise up in a substantially perpendicular direction from the surface of the piezoelectric elements 58 (pressure generating devices). A multilayer flexible cable 92 is provided above the electrical wires 90 which rise up in a substantially perpendicular direction from the surface of the piezoelectric elements 58. A drive signal is thus supplied from a head driver (not shown in FIG. 5) to the individual electrodes 57 of the piezoelectric elements 58 via the electrical wires 90.

Furthermore, the space in which the column-shaped electrical wires 90 are erected between the diaphragms 56 and the flexible cable 92 serves as a common liquid chamber 55 for supplying ink to the pressure chambers 52 via the ink supply ports 53.

The common liquid chamber 55 shown here has a single large space formed throughout the region where the plurality of pressure chambers 52 are formed, so as to supply ink to all of the pressure chambers 52 shown in FIG. 3. However, the common liquid chamber 55 is not limited to being formed into a single space, and the space may be divided into several regions, thus forming a plurality of chambers.

The electrical wires 90, which rise up perpendicularly like a column on top of the electrode pads 59 and is connected to the individual electrodes 57 at the pressure chambers 52, support the flexible cable 92 from below, thus creating a space which forms the common liquid chamber 55. The electrical wires 90 which rise up like columns in this way may also be called "electrical columns", due to their shape. In other words, the electrical wires 90 (electrical columns) are formed so as to pass through the common liquid chamber 55.

The electrical wires 90 shown here are formed with respect to the piezoelectric elements 58 (or the individual electrodes 57 thereof), respectively. However, it is also possible to make a single electrical wire 90 for the plurality of piezoelectric elements 58 in order to reduce the number of wires (the number of electrical columns), in such a manner that the wires for several piezoelectric elements 58 are gathered together and formed into one electrical wire 90. The wiring to the common electrode (the diaphragm 56) may also be formed with an electrical wire 90, in addition to the wiring to the individual electrodes 57.

As shown in FIG. 5, nozzles 51 are disposed in the bottom surface of the print head 50, and ink supply ports 53 are provided on the upper surface in corner sections which are symmetrical with respect to the nozzles 51 so as to penetrating the diaphragm 56. The common liquid chamber 55 and the pressure chambers 52 are thus connected directly through the ink supply ports 53. Consequently, it is possible to achieve a direct fluid channel between the common liquid chamber 55 and the pressure chambers 52.

The diaphragm 56 is formed as a single plate which serves for all of the pressure chambers 52. Piezoelectric elements 58 for deforming the pressure chambers 52 are disposed on the diaphragm 56 in positions corresponding to the respective pressure chambers 52. Electrodes (a common electrode and an individual electrode) that drives the piezoelectric elements 58 with a voltage applied to same are formed on the upper and lower surfaces of each piezoelectric element 58 in such a manner that the piezoelectric element 58 is between the two electrodes.

The diaphragm 56 may be formed as a thin conductive film made of stainless steel, or the like, in such a manner that the diaphragm 56 may also serve as a common electrode. The individual electrodes 57 for driving the piezoelectric elements 58 are disposed on the upper surfaces of the piezoelectric elements 58, respectively.

As described above, an electrode pad 59 connected to an individual electrode 57 is formed, and an electrical wire 90 (electrical column) which passes through the common liquid chamber 55 is formed rising up perpendicularly from the electrode pad 59. As shown in FIG. 5, the electrical wires 90 is formed in a tapered shape by the method of manufacturing the electrical wires 90 (electrical columns), which is described later.

A multi-layer flexible cable 92 is formed on top of the column-shaped electrical wires 90 and is supported by same, thereby forming a space which serves as the common liquid chamber 55. In this case the diaphragm 56 and the multi-layer flexible cable 92 correspond to the bottom and ceiling of the common liquid chamber 55, respectively. The respective individual electrodes 57 are connected to the electrical wires 90 through wires (not shown), respectively, thereby driving the piezoelectric elements 58.

Moreover, since the common liquid chamber 55 is filled with ink, then the parts of the diaphragm 56 (the common electrode), the individual electrodes 57, the electrical wires 90, and the multi-layer flexible cable 92, to be exposed to the ink are covered with an insulating protective film (not shown in FIG. 5).

Although there are no particular restrictions on the size of the print head 50 described above, the planar shape of the pressure chambers 52, for example, has a height of 150 μm and a size of 300 μm×300 μm in an approximately square shape (the corners thereof is chamfered in order to prevent stagnation in the ink flow), and the diaphragm 56 and the piezoelectric elements 58 has a thickness of 10 μm, the electrical wires 90 (electrical columns) have a height of 500 μm and a diameter of 100 μm at the connection with the electrode pad 59.

Figure 6:
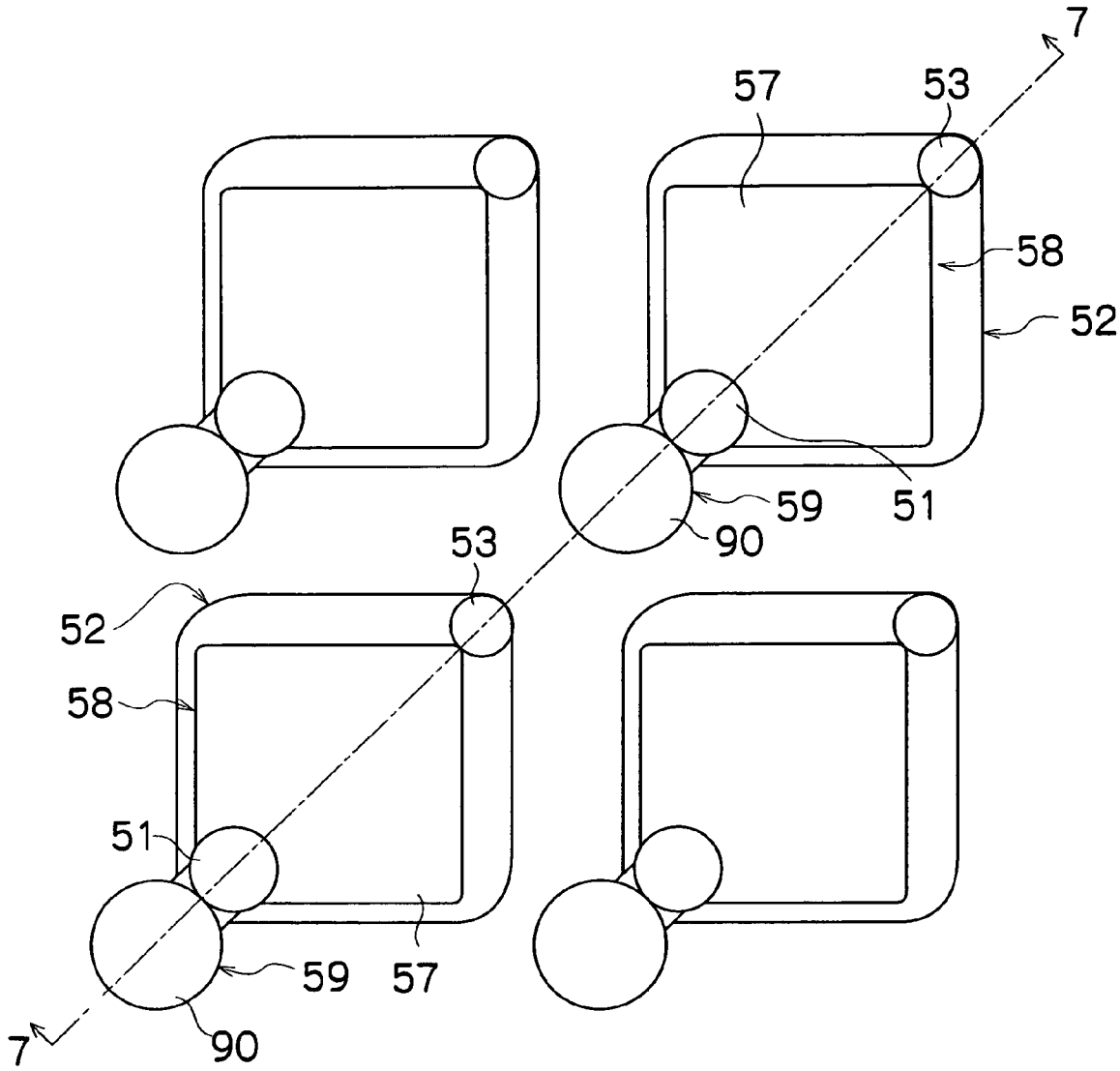
FIG. 6 is a plan view perspective diagram showing an enlarged view of a portion of pressure chambers.

FIG. 6 is an enlarged plan view perspective diagram showing one portion of the pressure chambers 52 described above. As described above, the pressure chamber 52 has a substantially square shape in which the nozzle 51 and the ink supply port 53 is formed at respective the diagonal corners, and the electrode pad 59 on which the electrical wire (electrical column) 90 is formed is extracted adjacently to the nozzle 51.

Figure 7:
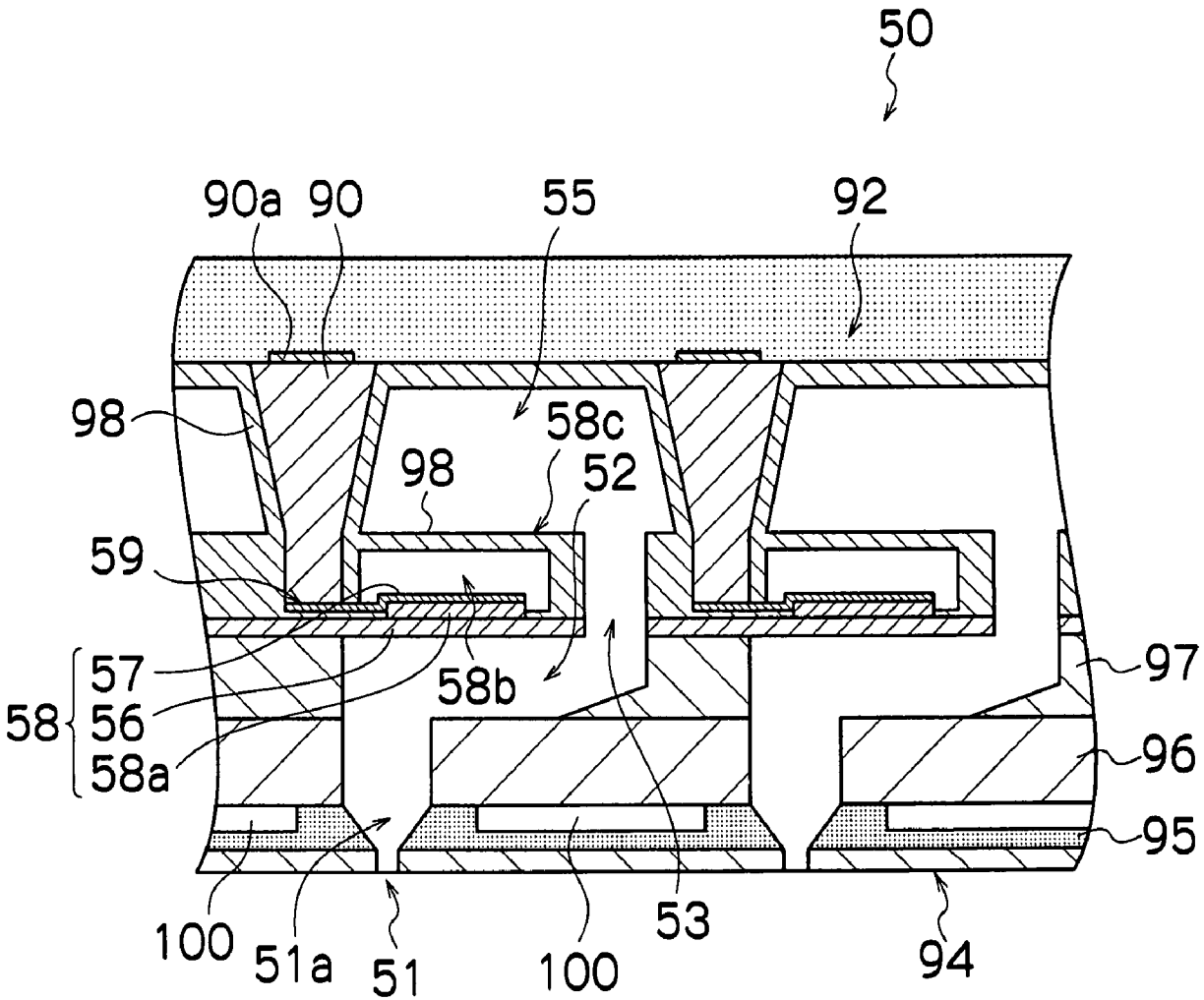
FIG. 7 is a cross-sectional diagram along line 7-7 in FIG. 6 and shows a print head according to an embodiment of the present invention.

FIG. 7 is a cross-sectional diagram along line 7-7 in FIG. 6.

As shown in FIG. 7, the print head 50 according to the present embodiment is laminated from a plurality of thin films/thin plates, or the like. Firstly, a circulation flow channel plate 95 which is made of a porous member and includes circulation flow channels 100 is bonded onto a nozzle plate 94 having nozzles 51, and then a nozzle flow channel plate 96 is bonded onto same. Nozzle flow channels (nozzle connection channels) 51*a* for connecting the pressure chambers 52 with the nozzles 51 are formed in the circulation flow channel plate 95 and the nozzle flow channel plate 96. Furthermore, a pressure chamber plate 97 in which pressure chambers 52 and ink supply ports 53 are formed is arranged onto the nozzle flow channel plate 96.

In FIG. 7, each of the circulation flow channel plate 95, the nozzle flow channel plate 96, the pressure chamber plate 97, and the like, is depicted as a single plate; however, in actual practice, each of these plates may be laminated from a plurality of plates.

A diaphragm 56 forming the ceiling faces of the pressure chambers 52 is bonded onto the pressure chamber plate 97. It is preferable that the diaphragm 56 also serve as a common electrode which drives the piezoelectric elements 58 described below in conjunction with the individual electrodes 57. Furthermore, opening sections corresponding to the ink supply ports 53 of the pressure chambers 52 are provided in the diaphragm 56. Thus, direct connections between the pressure chambers 52 and the common liquid chamber 55 formed on the upper side of the diaphragm 56, are achieved through the ink supply ports 53.

Piezoelectric bodies 58a are formed on the diaphragm 56 (common electrode) so as to cover substantially the whole upper surface of the respective pressure chambers 52, and an individual electrode 57 is formed on each of the piezoelectric bodies 58*a*. Each piezoelectric body 58*a*, which is thus interposed between the lower common electrode (the diaphragm 56) and an upper individual electrode 57, deforms the pressure chamber 52 and reduces the volume of same through a voltage applied between the common electrode 56 and the individual electrode 57. Thus, the piezoelectric bodies 58*a*, the lower common electrode (the diaphragm 56), and the upper individual electrodes 57 serve as piezoelectric elements 58 (piezoelectric actuators) which cause the ink to be ejected from the nozzles 51.

Each individual electrode 57 is extended outside on the nozzle 51 side in such a manner that an electrode pad 59 is formed as an electrical connecting section. Thereupon, the column-shaped electrical wires 90 (electrical columns) are formed perpendicularly on the respective electrode pads 59 in such a manner that they pass through the common liquid chamber 55.

The multi-layer flexible cable 92 is arranged on the electrical wires 90 in such a manner that wires (not shown) of the multi-layer flexible cable 92 are connected to the electrical wires 90 via electrodes pads 90*a*, thereby supplying drive signals for driving the piezoelectric elements 58 through the electrical wires 90.

Moreover, the space in which the column-shaped electrical wires 90 (electrical columns) are erected between the diaphragm 56 and the multi-layer flexible cable 92 functions as the common liquid chamber 55, which is filled with ink that is supposed to be supplied to the pressure chambers 52.

The common liquid chamber 55 is filled with ink, and hence an insulating and protective film 98 is formed on each of the parts of the surface of the electrical wires 90, multi-layer flexible cable 92, and the like, which make contact with the ink.

Next, casings (covers for the piezoelectric elements 58) 58*c* are formed so as to completely cover the piezoelectric elements 58 respectively, in such a manner that a space 58*b* for operation of each piezoelectric element 58 is formed on the upper side of each piezoelectric element 58. Moreover, an insulating and protective film 98 is formed on the surface of each of the casings (piezo cover) 58*c*. It is also possible to form the casings 58*c* made from the insulating and protective films 98 only. Since spaces 58*b* containing the piezoelectric elements 58 are formed by providing the casings 58*c* above the respective piezoelectric elements 58, then the resistance during driving of the piezoelectric elements 58 is reduced, the piezoelectric elements 58 can be operated more readily, and therefore the driving efficiency of the piezoelectric elements 58 is improved.

Figure 8:
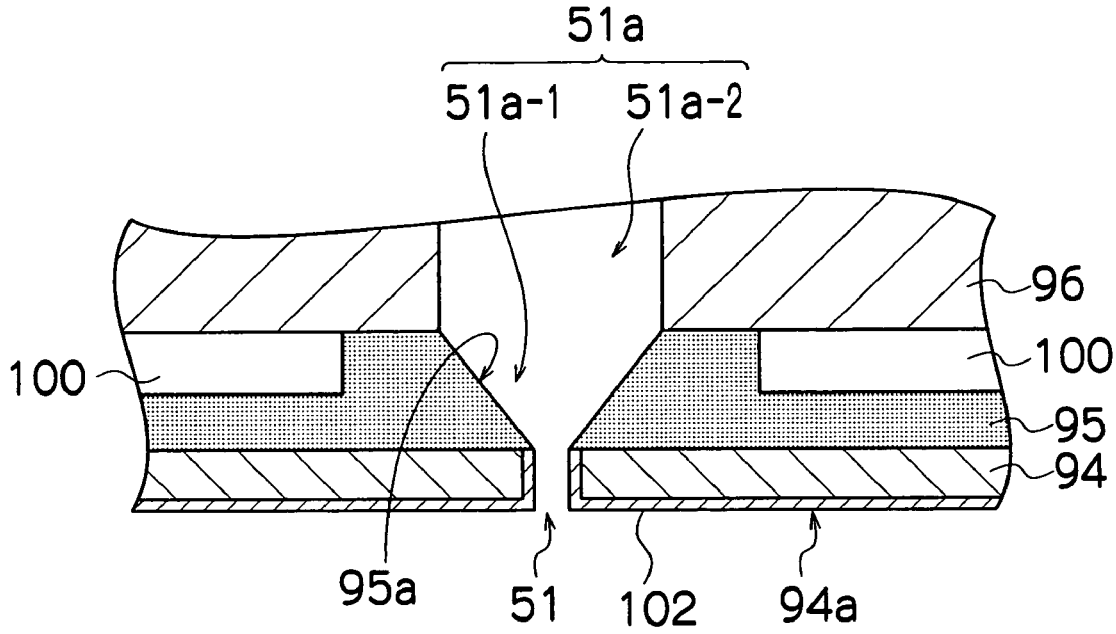
FIG. 8 is an enlarged view of the peripheral area of a nozzle of the print head shown in FIG. 7.

FIG. 8 is a diagram showing an enlarged view of the periphery of a nozzle 51 in the print head 50 shown in FIG. 7.

As shown in FIG. 8, the circulation flow channel plate 95 is arranged on the nozzle plate 94 having nozzles 51, and the nozzle flow channel plate 96 is arranged on same. A first nozzle flow channel 51*a*-1 and a second nozzle flow channel 51*a*-2 are formed in the circulation flow channel plate 95 and the nozzle flow channel plate 96, respectively. Each nozzle flow channel 51*a* (nozzle connection channel) which connects a nozzle 51 and a pressure chamber 52 (shown in FIG. 7) includes the first nozzle flow channel 51*a*-1 and the second nozzle flow channel 51*a*-2.

The ink is supplied from the ink tank (not shown in FIG. 8) to the common liquid chamber 55, and then the ink is supplied from the common liquid chamber 55 to the pressure chambers 52 through the ink supply ports 53. The pressure chambers 52 and the nozzles 51 are connected through the nozzle flow channels (nozzle connection channels 51*a*). When the ink has not been ejected from a nozzle (in the steady state), the internal pressure of the ink inside the nozzle flow channel 51*a* is equal to the internal pressure of the ink filled in the spaces (an ink supplying side) from the ink tank to the pressure chamber 52.

Each first nozzle flow channel 51*a*-1 in the circulation flow channel plate 95 is formed in a tapered shape in which the diameter (cross-sectional area) becomes smaller toward the nozzle 51 side (ejection side), as shown in FIG. 8.

Moreover, circulation flow channels 100 are formed in the circulation flow channel plate 95. The circulation flow channel plate 95 is made of a porous member that contains a large number of fine pores and is a porosity member which can be impregnated with ink.

Since the circulation flow channel plate 95 is made of a porous member in this way, then when ink ejection is not being performed (after the completion of refilling subsequent to ink ejection), it is possible to achieve a low-speed flow of ink from each pressure chamber 52 (i.e., from the ink supplying side) to a circulation flow channel 100 through the nozzle flow channel 51*a* and the porous member, by adjusting the relationship among the pressure inside the ink supplying side (the nozzle flow channel 51*a*), the ink pressure inside the circulation flow channels 100, and the atmosphere pressure, as described in detail later. In this way, ink of increased viscosity does not return to the pressure chamber 52. Consequently, the ink properties that have a great influence on the ejection characteristics are kept uniform in the supply restriction (not shown in FIG. 8), the pressure chamber 52, the nozzle 51, and the like, at all times. Hence stable ejection can be achieved.

Furthermore, a surface 94*a* of the nozzle plate 94, including the inner surfaces of the nozzles 51, is subjected to a liquid-repelling (ink-repelling) treatment by forming thereon a liquid-repelling (ink-repelling) film 102 made of a fluorine resin, or the like, and thereby the contact angle of ink at the surface 94*a* is greater than that at an inner surface 95*a* of the first nozzle flow channel 51*a*-1 formed in the circulation flow channel plate 95. For example, the circulation flow channel plate 95 and the nozzle plate 94 are made of porous stainless steel plate and polyimide sheet, respectively.

The term "contact angle" is the angle of a liquid droplet surface with respect to a surface of a solid at the contact section when the liquid droplet deposits on the surface of the solid, and the angle between the surface of the solid and the tangent line of the liquid droplet surface at the contact section. If the solid surface has hydrophilic properties (i.e., a strong affinity for the liquid), then a liquid droplet spreads thinly and flatly over the solid surface and the contact angle is small, whereas if the solid surface has hydrophobic properties (i.e., little or no affinity for the liquid), then a liquid droplet forms a round shape, like a sphere, and the contact angle is large.

Figure 9A:
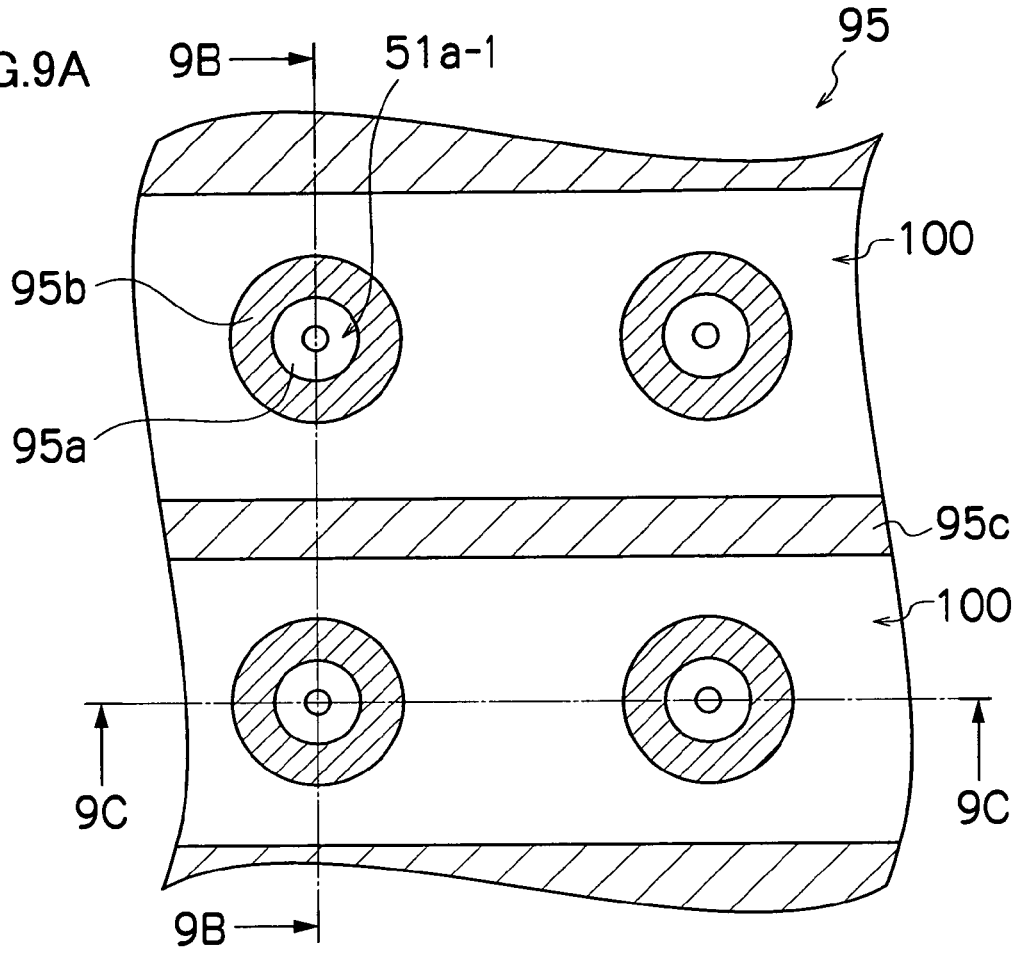
FIG. 9A is a plan diagram showing a circulation flow channel plate.
Figure 9B:
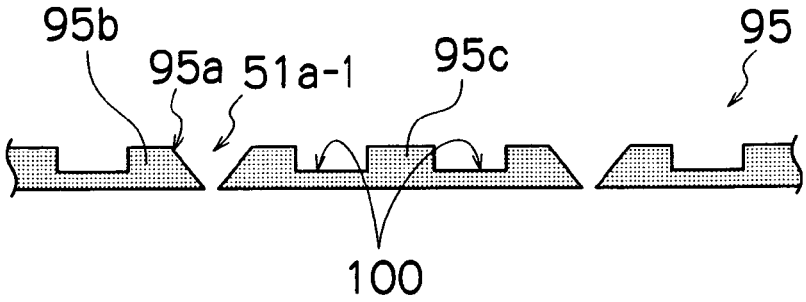
FIG. 9B is a cross-sectional diagram along line 9B-9B in FIG. 9A showing the circulation flow channel plate.
Figure 9C:
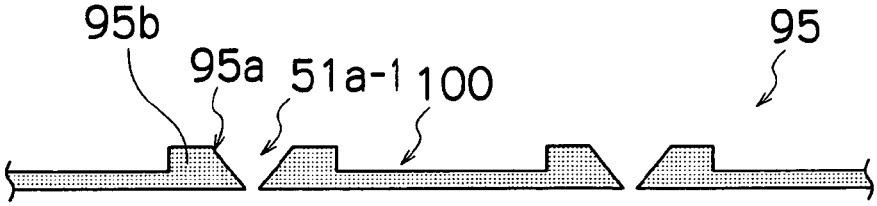
FIG. 9C is a cross-sectional diagram along line 9C-9C in FIG. 9A showing the circulation flow channel plate.

FIGS. 9A to 9C are diagrams showing a circulation flow channel plate 95. FIG. 9A is a plan diagram of a circulation flow channel plate 95, and FIGS. 9B and 9C are cross-sectional diagrams along lines 9B-9B and 9C-9C in FIG. 9A, respectively.

As shown in FIG. 9A, first nozzle flow channels 51*a*-1 are formed in the circulation flow channel plate 95. The first nozzle flow channels 51*a*-1 are formed inside circular tubular ribs 95*b*. The outer sides of the circular tubular ribs 95*b* in which the first nozzle flow channels 51*a*-1 are formed constitute the circulation flow channels 100. The circulation flow channels 100 are divided by means of wall-shaped ribs 95*c*, in such a manner that the ink flows in a prescribed direction.

As shown in FIGS. 9B or 9C, the inner surfaces of the circular tubular ribs 95b, namely, the inner surfaces of the first nozzle flow channels 51*a*-1, are formed in a tapered shape in such a manner that the cross section gradually becomes smaller toward the nozzle 51 side (the lower side in FIGS. 9B and 9C).

The circulation flow channel system formed in the circulation flow channel plate 95 is constituted by circulation flow channels 100 having a larger cross-sectional area than the nozzles, and countless flow channels (porous flow channels) which are formed by the porous member and have a smaller cross-sectional area than the nozzles.

In order to form countless small flow channels described above, it is preferable to use porous stainless steel as the material for the circulation flow channel plate 95.

In this way, by forming at least the peripheral regions of the first nozzle flow channels 51*a*-1 in the circulation flow channel plate 95 with a porous member, it is possible to make ink impregnate into the porous member from the first nozzle flow channels 51*a*-1, and hence ink of increased viscosity can be expelled into the circulation flow channels 100.

According to the present embodiment, only second nozzle flow channels 51*a*-2 are formed in the nozzle flow channel plate 96.

Next, the relationship among the ink pressure inside the nozzle flow channels 51*a*, the ink pressure inside the ink supplying side, such as the pressure chambers 52, and the ink pressure inside the circulation flow channels 100 is described.

Figure 10:
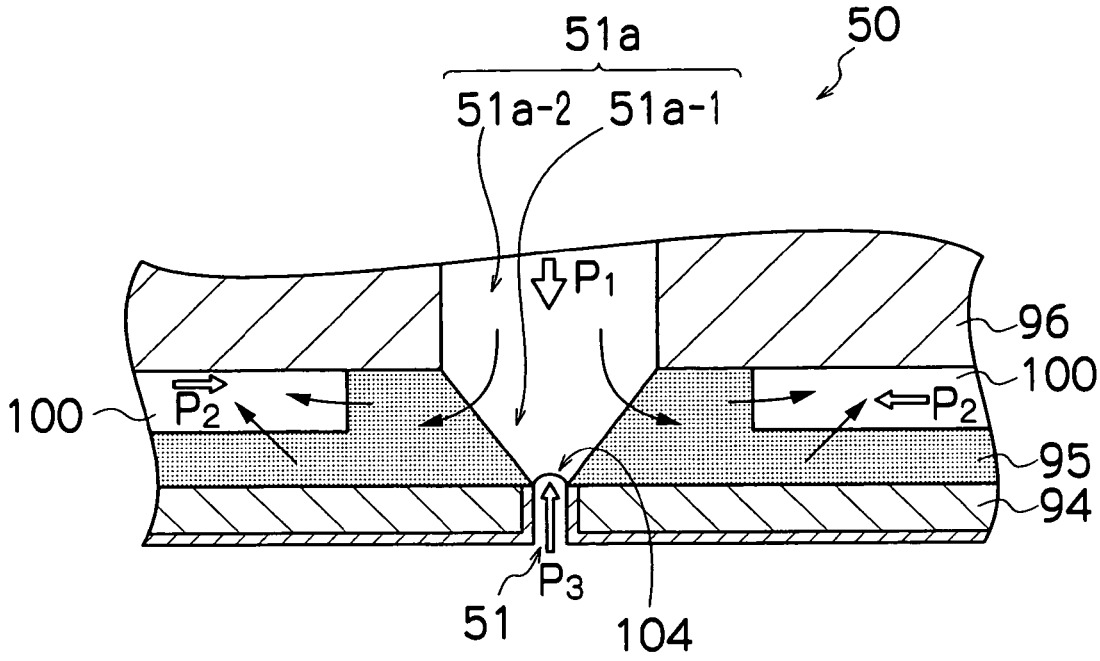
FIG. 10 is a cross-sectional diagram showing the relationship between internal ink pressures in the vicinity of a nozzle in the steady state.

FIG. 10 is a schematic diagram showing the state of the ink pressure and ink flow in the peripheral region of a nozzle 51 in the steady state.

As shown in FIG. 10, taking $P_1$ to be the ink pressure inside a nozzle flow channel 51*a* connected to an ink supplying side (in the steady state where ink has not been ejected, the internal ink pressure in the ink supplying side which supplies ink to the pressure chamber 52 is equal to the ink pressure in the nozzle flow channel 51*a*), taking $P_2$ to be the ink pressure inside the circulation flow channel 100, and taking $P_3$ to be the atmospheric pressure, then the following relationship is established: $P_3>P_1>P_2$.

As described above, the contact angle of the ink with respect to the surface 94*a* of the nozzle plate 94 is greater than the contact angle of the ink with respect to the inner surface of the first nozzle flow channel 51*a*-1 formed in the circulation flow channel plate 95. In other words, the nozzle plate 94 has greater ink repelling properties (smaller affinity for the ink) than the nozzle flow channel 51*a*-1.

The ink pressure is controlled as described above in such a manner that the atmospheric pressure $P_3$ is the highest, followed by the ink pressure $P_1$ inside the nozzle flow channel 51 a (ink supplying side), and the ink pressure $P_2$ inside the circulation flow channel 100 is the lowest. According to the pressure control and contact angle conditions described above, in the steady state, the end (clip points) of the meniscus 104 of the ink is fixed (clipped) at the boundary between the nozzle 51 and the first nozzle flow channel 51*a*-1 (i.e., the boundary between the nozzle plate 94 and the circulation flow channel plate 95) as shown in FIG. 10.

In this case, as described above, since the ink pressure $P_1$ inside the nozzle flow channel 51 a (ink supplying side) is made smaller than the atmospheric pressure $P_3$, then there is no leaking of the ink from the nozzle 51. Moreover, since the ink pressure $P_2$ inside the circulation flow channels 100 is smaller than the ink pressure $P_1$ inside the nozzle flow channel 51*a*, then the ink flows from the nozzle flow channel 51*a* to the circulation flow channel 100 through the porous member, and hence ink of increased viscosity is expelled through the circulation flow channels 100, rather than returning to the nozzle 51 and the pressure chamber 52.

Thus, the ink properties in the supply restrictors (which are provided on the ink supply ports 53 and are not shown in FIG. 10), the pressure chambers 52, and the nozzles 51, which have an important influence on the ejection characteristics, are always kept equally, and therefore stable ejection can be achieved.

Figure 11:
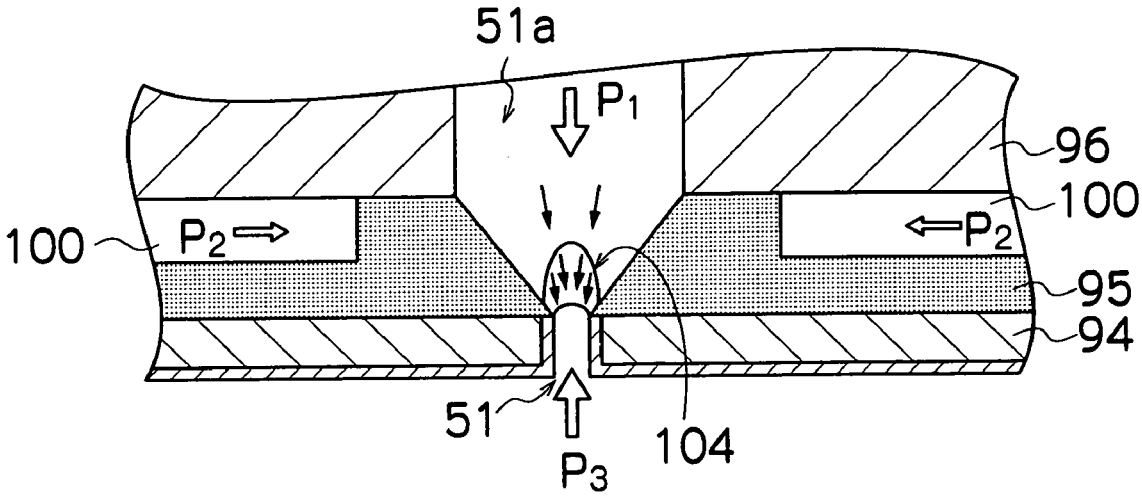
FIG. 11 is a cross-sectional diagram showing the relationship between internal ink pressures in the vicinity of a nozzle in the refilling state.

FIG. 11 is a diagram showing a state of the ink in the peripheral region of a nozzle 51 during refilling.

As shown in FIG. 11, since the ink meniscus surface 104 which has retreated as a result of ink ejection seeks to return to the position in steady state shown in FIG. 10 because of the surface tension, then the ink is supplied from the ink supplying side connected to the nozzle flow channel 51*a*.

In this case, as described above, since the ink pressure $P_2$ inside the circulation flow path 100 is lower than the ink pressure $P_1$ inside the nozzle flow channel 51*a*, and since the flow channel resistance of the circulation flow channel 100 is greater than that of the ink supplying side connected to the nozzle flow channel 51*a*, then the ink is not supplied to the nozzle flow channel 51*a* from the circulation flow channel 100. Consequently, the ink of increased viscosity does not flow back to the nozzle 51 side.

Next, the driving of a piezoelectric element 58 during ejection is described.

Figure 12A:
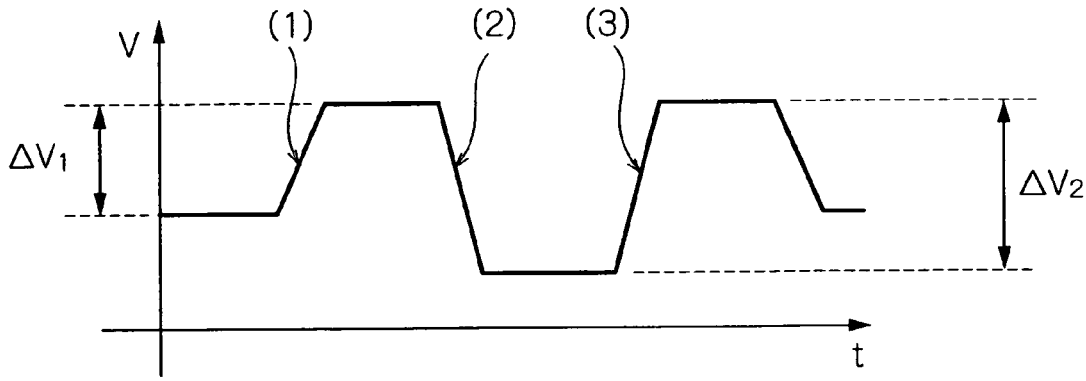
FIGS. 12A and 12B are graphs showing drive waveforms according to embodiments of the present invention.
Figure 12B:
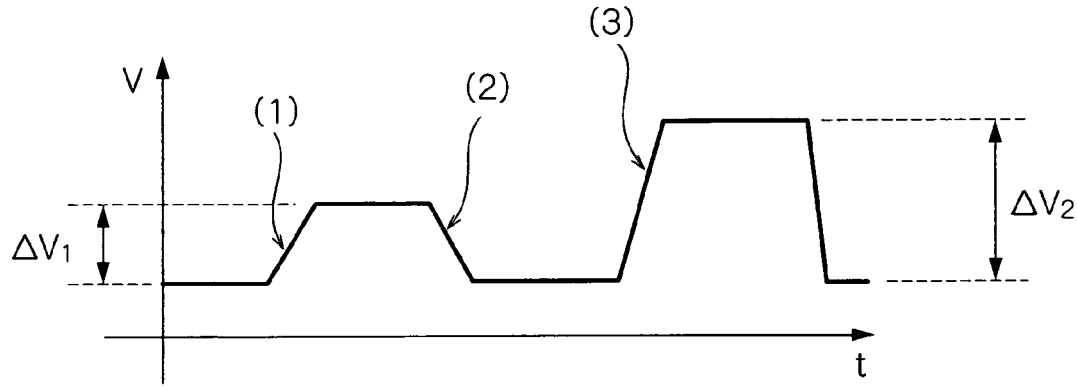

FIGS. 12A and 12B are diagrams showing drive waveforms during ejection. In both FIGS. 12A and 12B, the horizontal axis and the vertical axis denote time and voltage, respectively.

Figure 13A:
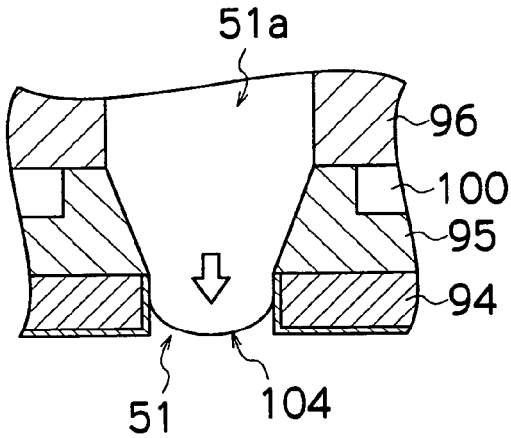
FIGS. 13A, 13B and 13C are diagrams showing states of the meniscus surface during ejection.

In the drive waveform shown in FIG. 12A, firstly, as shown in the portion (1), a voltage is applied to a piezoelectric element 58, thereby charging the piezoelectric element 58. Thus, as shown in FIG. 13A, the end (clip points) of the meniscus surface 104 (i.e., the boundary among the atmosphere, the meniscus 104, and the inner surface of the nozzle 51) of the ink inside the nozzle flow channel 51*a* moves in the ejection direction, but the ink is not ejected. In this case, the end of meniscus surface 104 moves to a position on the inner surface of the nozzle 51 in the nozzle plate 94 as shown in FIG. 13A, whereas, in the steady state, the end of the meniscus surface 104 is situated at the boundary between the nozzle 51 and the first nozzle flow channel 51*a*-1 as shown in FIG. 10.

Figure 13B:
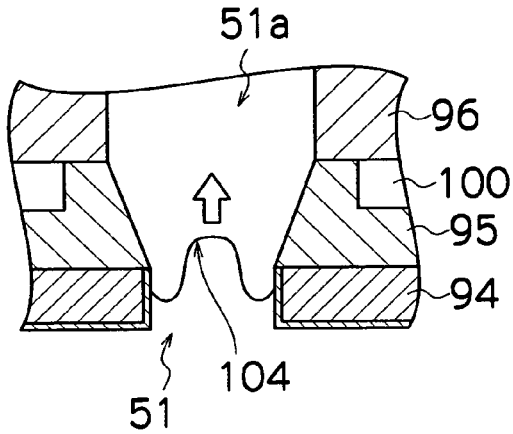

Thereupon, by reducing the voltage as shown in the portion (2) in FIG. 12A, the central of the ink meniscus surface 104 is withdrawn inside the nozzle flow channel 51*a*, as shown in FIG. 13B.

Figure 13C:
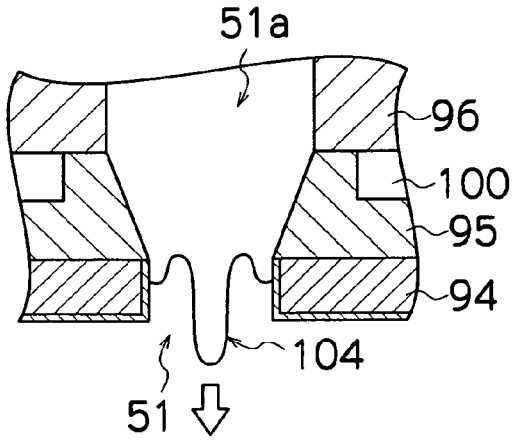

Then, as shown in the portion (3) in FIG. 12A, a voltage is applied (increased) again, and thereby the central portion of the ink meniscus surface 104 projects and the ink is ejected as shown in FIG. 13C. As described above, in this case, the ink is initially pushed, causing the meniscus surface 104 to move toward the ejection side, the ink is then pulled, causing the central portion of the meniscus surface 104 to be pulled inside the nozzle flow channel 51*a*, and the ink is then pushed again towards the ejection side, thus ejecting the ink.

In this case, the relationship between the voltage differential $\Delta V$, of the first charging waveform portion, and the voltage differential $\Delta V_2$ of the second charging waveform portion (ejection waveform) is such that the second voltage differential $\Delta V_2$ is greater than the first charging voltage differential $\Delta V_1$, in other words, $\Delta V_1<\Delta V_2$. In this way, the ink is ejected by applying the second charging waveform portion which is larger than the first charging waveform portion that is used only for moving the meniscus surface 104.

Figure 14A:
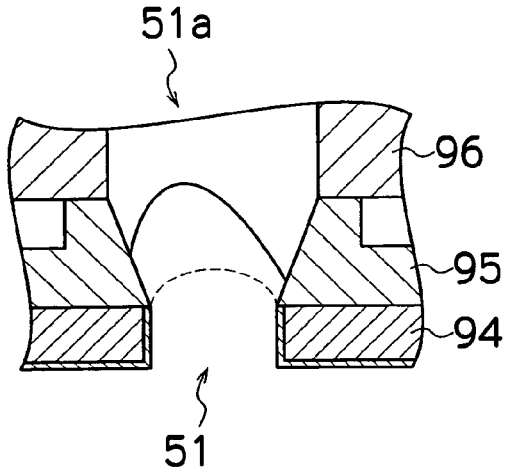
FIGS. 14A, 14B and 14C are diagrams showing states of the meniscus surface when ejection is performed by pulling the meniscus initially.
Figure 14B:
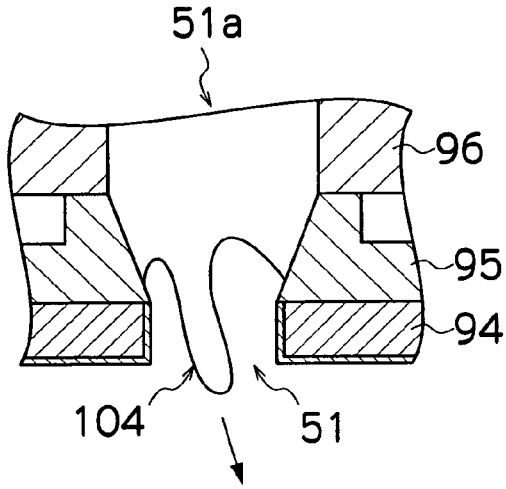
Figure 14C:
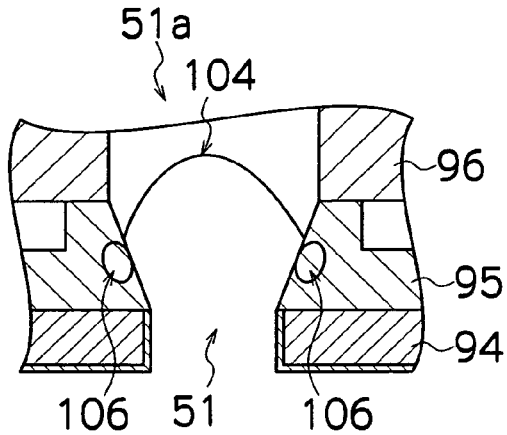

For the purpose of comparison, FIGS. 14A to 14C show states of a meniscus surface in a case where a standard waveform for pulling the meniscus surface is applied first.

As shown in FIG. 14A, if pulling of the meniscus surface 104 is carried out first, then the end (clip points) of the meniscus surface 104 moves into the region of the porous member of the circulation flow channel plate 95 in the nozzle flow channel 51*a*.

If the ink is then pushed and ejected as shown in FIG. 14B, the shape of the meniscus surface is disrupted during ejection, and the ejection direction of the ink is deflected. After the ejection, air bubbles 106 may enter into the porous member as shown in FIG. 14C. If air bubbles 106 enter into the porous member in this way, then the fine flow channels formed by the porous member become blocked off, and hence it becomes difficult to expel the ink of increased viscosity into the circulation flow channels 100 and to prevent increase in the viscosity of the ink inside the nozzle 51.

On the other hand, in the present embodiment, a waveform is input as described above which initially causes an ink meniscus surface 104 to move in the ejection direction to an extent which does not produce ejection. Therefore, as shown in FIG. 13A, the meniscus surface 104 moves to the inner surface of the nozzle 51 in the nozzle plate 94, while the end (clip points) of the meniscus surface 104 is not withdrawn into the region of the porous member. Thus, the problems described above with reference to FIGS. 14A to 14C are resolved.

In other words, by applying a drive waveform such as that shown in FIG. 12A, the end (clip points) of the meniscus can be reliably prevented from reaching the porous member, and therefore, it is possible to prevent unevenness in the meniscus surface or the infiltration of air bubbles, and hence stable ejection can be achieved.

For the drive waveform, apart from the waveform shown in FIG. 12A, the waveform shown in FIG. 12B may also be used. The waveform shown in FIG. 12B differs from the waveform shown in FIG. 12A in that the amount (degree) of the ink which is pulled after being pushed first is reduced. However, in the waveform shown in FIG. 12B, the voltage differential $\Delta V_2$ of the second charging waveform portion is also greater than the voltage differential $\Delta V_1$ of the first charging waveform portion, in other words, $\Delta V_1 < \Delta V_2$.

Next, an ink supply system which achieves the ink circulation described above is explained.

Figure 15:
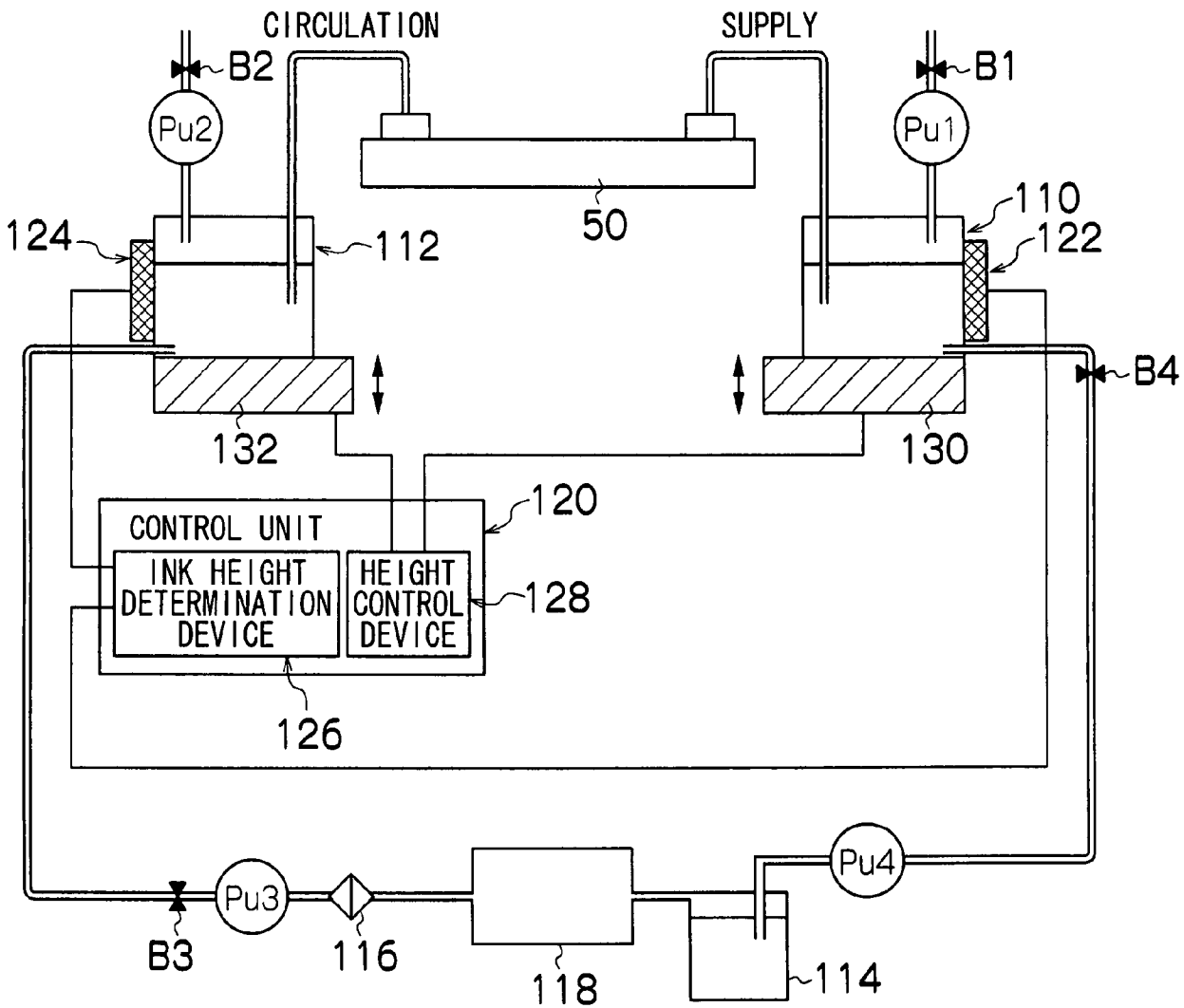
FIG. 15 is a general schematic drawing showing an ink supply system according to a first embodiment.

FIG. 15 shows an approximate view of an ink supply system according to the present embodiment.

As shown in FIG. 15, the ink supply system according to the present embodiment comprises a supply bottle (container) 110 which supplies the ink to the print head 50, a circulation bottle 112 which accumulates the ink expelled from the print head 50, and an ink tank 114 to which receives the circulated ink from the circulation bottle 112 and sends the ink to the supply bottle 110.

A pump Pu1 and a valve B1 are attached to the supply bottle 110, and a pump Pu2 and a valve B2 are attached to the circulation bottle 112. Moreover, a pump Pu3 and a valve B3 are provided in the channel connecting the circulation bottle 112 and the ink tank 114, and a pump Pu4 and a valve B4 are provided in the channel connecting the ink tank 114 and the supply bottle 110.

Moreover, since the ink entering into the circulation bottle 112 is generally ink of increased viscosity, then a filter 116 and a viscosity adjusting mechanism 118 are provided in the channel connecting the circulation bottle 112 and the ink tank 114.

The initial filling of the ink to the print head 50 is carried out by applying pressure to the supply bottle 110 by means of the pump Pu1 and simultaneously reducing the pressure in the circulation bottle 112 by means of the pump Pu2. After filling the ink to the print head 50, the aforementioned relationship between the ink pressure $P_1$ in the nozzle flow channels 51*a*, the ink pressure $P_2$ in the circulation flow channels 100, and the atmospheric pressure $P_3$, namely $P_3 > P_1 > P_2$, is achieved by controlling the liquid heights in the supply bottle 110 and the circulation bottle 112.

In order to achieve this relationship, a height measurement sensor 122 is disposed in the supply bottle 110, and a height measurement sensor 124 is disposed in the circulation bottle 112. The determination signals from these height measurement sensors 122 and 124 are sent to an ink height determination device 126 in the control unit 120. The ink height determination device 126 determines the ink levels of the two bottles on the basis of the supplied determination signals.

Moreover, elevator devices 130 and 132 are provided on the supply bottle 110 and the circulation bottle 112, respectively. Upon receiving the determination results from the ink height determination device 126, the height control device 128 drives the elevator devices 130 and 132, thereby controlling the ink levels of the supply bottle 110 and the circulation bottle 112 in such a manner that the ink pressures satisfy the aforementioned relationship expressed as $P_3 > P_1 > P_2$.

As described above, according to the present embodiment, ink flow channels for circulation which are made of a porous member are formed in the print head on the opposite side of the nozzle plate from the ejection side, and therefore, the end (clip points) of the ink meniscus surface does not make contact with the porous member during ejection. Consequently, the meniscus surface does not become uneven and air bubbles are not took into the porous member, and hence stable ejection can be achieved.

Furthermore, since the relationship between the ink pressure $P_1$ in the nozzle flow channel 51*a* (supply side), the ink pressure $P_2$ in the circulation flow channel, and the atmospheric pressure $P_3$ is expressed as $P_3 > P_1 > P_2$, then the flow of the ink circulation travels from a pressure chamber (supply side) to the ink meniscus in the nozzle and then into the porous member (circulation flow channel), thus preventing the ink having an increased viscosity from returning to the pressure chamber. Consequently, the ink properties in the supply restrictors, the pressure chambers and the nozzles, which have an important influence on the ejection characteristics, are always uniform, and stable ejection can be achieved.

Moreover, since a waveform which moves the meniscus surface in the ejection direction during ejection is set as the first waveform, then the clip points of the meniscus surface can be prevented more reliably from entering into the region of the porous member. Thus, the meniscus surface does not become uneven and there is no infiltration of air bubbles, and hence stable ejection can be achieved.

Next, a second embodiment according to the present invention is described.

Figure 16:
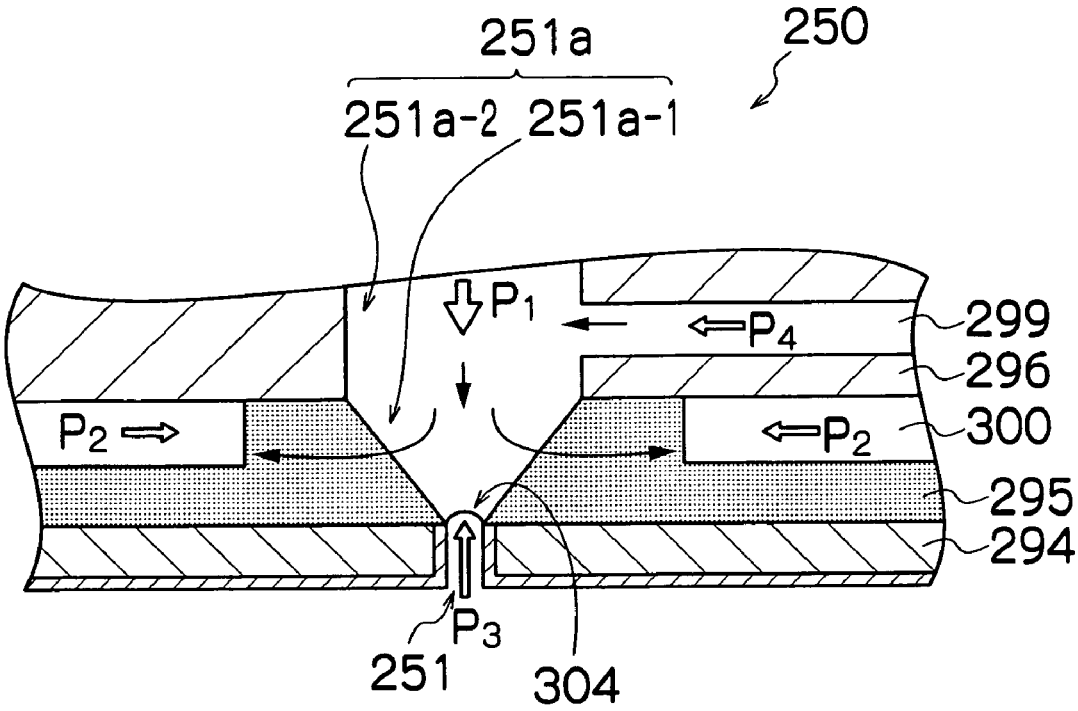
FIG. 16 is a plan diagram showing the peripheral region of a nozzle in a print head according to a second embodiment of the present invention.

FIG. 16 is a cross-sectional diagram showing an approximate view of the vicinity of a nozzle in the inkjet recording head (print head) according to the second embodiment of the present invention.

As shown in FIG. 16, the print head 250 according to the second embodiment has a composition that is substantially the same as that of the print head 50 according to the first embodiment shown in FIG. 10, and furthermore, refilling supply channels 299 are provided in the nozzle flow channel plate (in the present embodiment, the nozzle flow channel plate 296).

The refilling supply channels 299 serve for refilling the ink into the nozzle flow channels 251 a after ejection. In order to supply the ink to the nozzle flow channels 251 a from the respective refilling supply channels 299, the relationship among the ink pressures is adjusted in such a manner that the ink pressure $P_4$ in a refilling supply channel 299 is greater than the ink pressure $P_2$ inside the corresponding circulation flow channels 300, and is lower than the atmospheric pressure $P_3$. In other words, the pressures are controlled in such a manner that $P_3>P_4>P_2$. Simultaneously, in this case, the relationship among the ink pressure $P_1$ inside the nozzle flow channel 251*a*, the ink pressure $P_2$ inside the circulation flow channel 300 and the atmospheric pressure $P_3$ is controlled so as to meet the inequality expressed as $P_3>P_1>P_2$, similarly to the first embodiment described above.

By adjusting the ink pressure in this way, the ink is circulated as denoted by the black arrow in FIG. 16.

Although the relationship among the ink pressure $P_1$ inside the nozzle flow channel 251*a*, the ink pressure $P_2$ inside the circulation flow channel 300, the atmospheric pressure $P_3$ and ink pressure $P_4$ inside the refilling supply channel 299 are set according to the two inequality relationships described above, the relationship between $P_1$ and $P_4$ is not specified in these inequalities. Since both $P_1$ and $P_4$ are higher than $P_2$, then the ink flow is created from the supply channel (nozzle flow channel 251*a*) and the refilling supply channel 299 to the circulation flow channel 300 through the porous member.

As described later, the pressure P4 can be controlled similarly to the pressures P1 and P2.

Furthermore, similarly to the first embodiment described above, the surface of the nozzle plate 294, including the inner surface of the nozzle 251, is formed in such a manner that the contact angle of the ink at the surface of same is larger than that at the inner surface of the first nozzle flow channel 251*a*-1 formed in the circulation flow channel plate 295. In other words, the nozzle 251 has greater ink-repelling properties than the first nozzle flow channel 251*a*-1.

As shown in FIG. 16, in the steady state, due to the pressure and contact angle conditions, the end (clip points) of the meniscus surface 304 is positioned at the boundary between the nozzle 251 and the first nozzle flow channel 251*a*-1.

Moreover, in this case, due to the differentials among the ink pressure $P_2$ in the circulation flow channel 300, the ink pressure $P_1$ of the nozzle flow channel 251*a* (supply side) and the ink pressure $P_4$ of the refilling supply channel 299, the ink is supplied to the nozzle and is expelled through the circulation flow channels 300. Further, since the flow resistance of each circulation flow channel 300 is greater than those of the nozzle flow channel 251*a* (supply side) and the refilling supply channel 299, then the ink is not supplied to the nozzle from the circulation flow channel 300. Therefore, the ink of increased viscosity does not return to the nozzle 251.

Furthermore, in a refilling state, the ink is supplied from the supply channel (supply channel on pressure chamber) and the filling supply channel 299, because of the surface tension of the meniscus.

In this way, in the present embodiment, the viscosity of ink at the meniscus is prevented from increasing, and the ink having an increased viscosity can be prevented from returning to the pressure chambers 52, thus making it possible to achieve stable ejection.

In FIG. 16, elements which are the same as those of the first embodiment described above are denoted by reference numerals having the same last two digits, and further description thereof is omitted here.

Figure 17A:
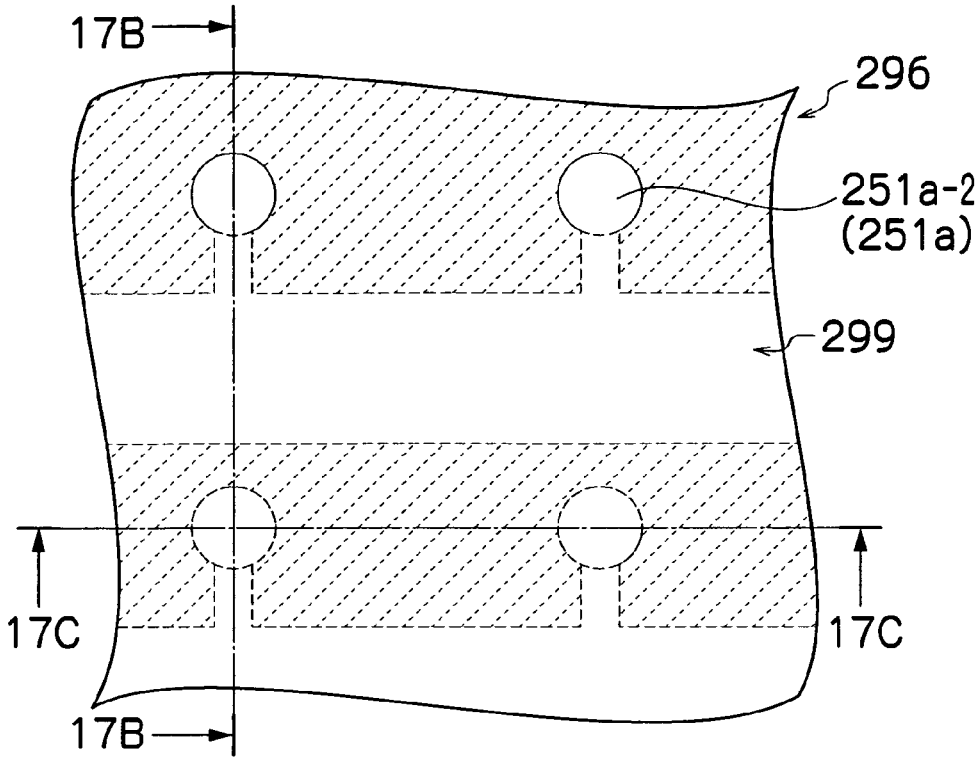
FIG. 17A is a plan diagram showing a circulation flow channel plate according to the second embodiment.
Figure 17B:
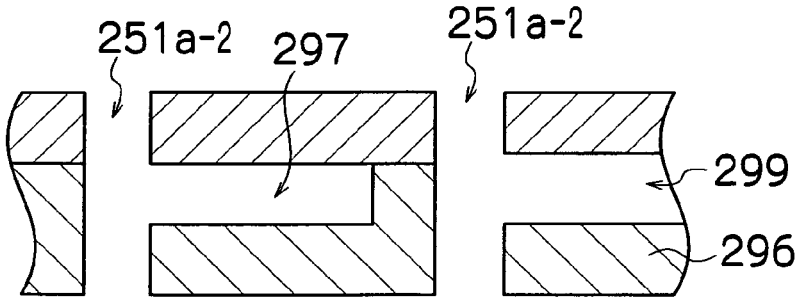
FIG. 17B is a cross-sectional diagram along line 17B-17B in FIG. 17A showing the circulation flow channel plate according to the second embodiment.
Figure 17C:
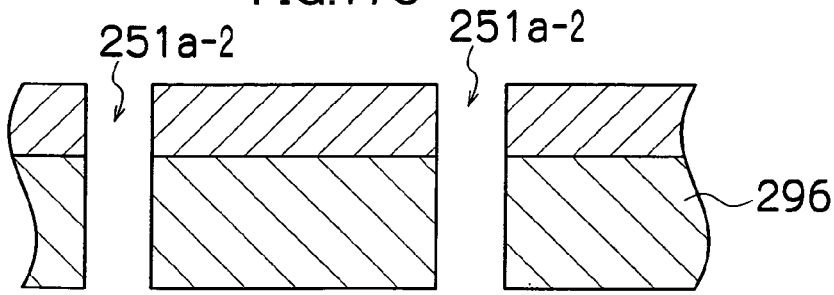
FIG. 17C is a cross-sectional diagram along line 17C-17C in FIG. 17A showing the circulation flow channel plate according to the second embodiment.

FIGS. 17A to 17C are diagrams showing a nozzle flow channel plate 296. FIG. 17A is a plan diagram of a nozzle flow channel plate 296, FIGS. 17B and 17C are cross-sectional diagrams along line 17B-17B and 17C-17C in FIG. 17A, respectively.

As shown in FIGS. 17A to 17C, the second nozzle flow channels 251*a*-2 are formed in the nozzle flow channel plate 296, and the refilling supply channels 299 are formed so as to be connected with the second nozzle flow channels 251*a*-2. Although there are no particular restrictions on the composition, in a composition shown in FIGS. 17A to 17C, the nozzle flow channel plate 296 is formed by at least two or more plates in order to simplify the processing of the refilling supply channels 299.

Figure 18:
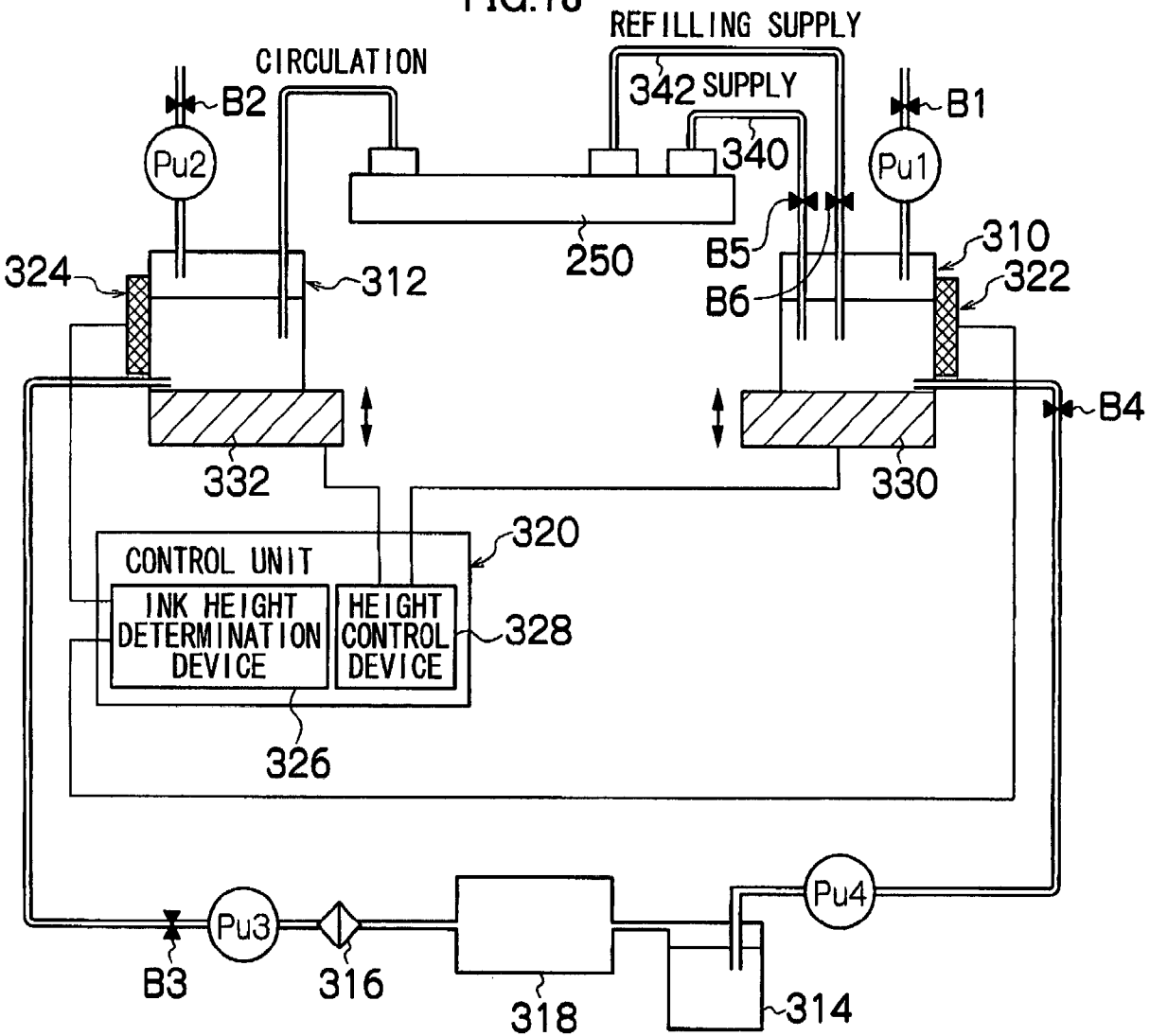
FIG. 18 is a general schematic drawing showing an ink supply system according to the second embodiment.

FIG. 18 is a diagram showing an approximate view of an ink supply system according to the present embodiment.

The ink supply system according to the present embodiment shown in FIG. 18 is approximately similar to the composition of the ink supply system according to the first embodiment described above with reference to FIG. 15. The present embodiment differs from the first embodiment in that it further includes a refilling supply tube 342 for supplying the ink to each refilling supply channel 299 from the supply bottle 310, in addition to the supply tube 340 for supplying the ink to the supply channel (not shown) from the supply bottle 310.

Moreover, valves B5 and B6 are provided respectively on the supply tube 340 and the refilling supply tube 342. Therefore, in a case where the pressures $P_1$ and $P_4$ are set so as to be equal, for example, the initial filling is carried out using these valves B5 and B6.

More specifically, during the initial filling, in order to fill the supply channel, the valve B6 provided in the refilling supply tube 342 is closed. On the other hand, in order to fill each refilling supply channel 299, the valve B5 provided in the supply tube 340 is closed. In this way, the initial filling can be carried out in a reliable fashion.

In FIG. 18, constituent elements which are the same as those of the first embodiment shown in FIG. 15 are denoted by reference numerals having the same last two digits, and detailed description thereof is omitted here.

Although an inkjet recording head and an image forming apparatus comprising an inkjet recording head according to the present invention have been described in detail above, the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head, comprising:

a pressure chamber to which ink is supplied from an ink supply side;

a nozzle plate including a nozzle which is connected to the pressure chamber and ejects the ink; and a circulation flow channel plate which is disposed on an opposite side of the nozzle plate from an ink ejection side, and includes: a circulation flow channel for expelling the ink from a vicinity of the nozzle; and a first nozzle flow channel for connecting the nozzle with the pressure chamber, wherein:

at least a portion of the circulation flow channel plate is made of a porous member;

a contact angle of the ink at an inner surface of the nozzle of the nozzle plate and a contact angle of the ink at an ink ejection side surface of the nozzle plate are greater than a contact angle of the ink at an inner surface of the first nozzle flow channel; and relationship among an internal ink pressure P1 in the ink supply side, an internal ink pressure P2 in the circulation flow channel, and an atmospheric pressure P3, is expressed as follows: P3>P1>P2.

2. The inkjet recording head as defined in claim 1, further comprising a piezoelectric element which functions as a pressure generating device for ejecting the ink, wherein:

the piezoelectric element is charged by applying a first charging waveform for driving the piezoelectric element to the piezoelectric element in such a manner that a meniscus of the ink moves in an ejection direction to an extent which does not cause the ink to be ejected;

the piezoelectric element is charged by applying a second charging waveform for driving the piezoelectric element to the piezoelectric element in such a manner that the meniscus moves in the ejection direction to eject the ink; and relationship between a potential difference ΔV1 of the first charging waveform and a potential difference ΔV2 of the second charging waveform is expressed as follows: ΔV1<ΔV2.

3. The inkjet recording head as defined in claim 1, wherein the relationship among the internal ink pressure P1, the internal ink pressure P2 and the atmospheric pressure P3 which is expressed as P3>P1>P2 is achieved by controlling a liquid level of at least one of an ink container connected to the ink supply side and an ink container connected to the circulation flow channel.

4. An image forming apparatus comprising the inkjet recording head as defined in claim 1.

5. An inkjet recording head, comprising:

a pressure chamber to which ink is supplied from an ink supply side;

a nozzle plate including a nozzle which is connected to the pressure chamber and ejects the ink;

a circulation flow channel plate which is disposed on an opposite side of the nozzle plate from an ink ejection side, and includes: a circulation flow channel for expelling the ink from a vicinity of the nozzle; and a first nozzle flow channel for connecting the nozzle with the pressure chamber; and a nozzle flow channel plate which is disposed on an opposite side of the circulation flow channel plate from the nozzle plate, and includes: a second nozzle flow channel for connecting the nozzle with the pressure chamber; and a refilling supply channel which supplies the ink to the second nozzle flow channel, wherein:

at least a portion of the circulation flow channel plate is made of a porous member;

a contact angle of the ink at an inner surface of the nozzle of the nozzle plate and a contact angle of the ink at an ink ejection side surface of the nozzle plate are greater than a contact angle of the ink at an inner surface of the first nozzle flow channel;

relationship among an internal ink pressure P1 in the ink supply side, an internal ink pressure P2 in the circulation flow channel, and an atmospheric pressure P3, is expressed as follows: P3>P1>P2; and relationship among the internal ink pressure P2 in the circulation flow channel, the atmospheric pressure P3, and an internal ink pressure P4 in the refilling supply channel is expressed as follows: P3>P4>P2.

6. The inkjet recording head as defined in claim 5, further comprising a piezoelectric element which functions as a pressure generating device for ejecting the ink, wherein:

the piezoelectric element is charged by applying a first charging waveform for driving the piezoelectric element to the piezoelectric element in such a manner that a meniscus of the ink moves in an ejection direction to an extent which does not cause the ink to be ejected;

the piezoelectric element is charged by applying a second charging waveform for driving the piezoelectric element to the piezoelectric element in such a manner that the meniscus moves in the ejection direction to eject the ink; and relationship between a potential difference ΔV1 of the first charging waveform and a potential difference ΔV2 of the second charging waveform is expressed as follows: ΔV1<ΔV2.

7. The inkjet recording head as defined in claim 2, wherein at least one of the relationship among the internal ink pressure P1, internal ink pressure P2 and the atmospheric pressure P3 which is expressed as P3>P1>P2 and the relationship between the internal ink pressure P2, the internal ink pressure P4 and the atmospheric pressure P3 which is expressed as P3>P4>P2 is achieved by controlling a liquid level of at least one of an ink container connected to the ink supply side and an ink container connected to the circulation flow channel.

8. An image forming apparatus comprising the inkjet recording head as defined in claim 5.

* * * * *